US010856709B2

(12) United States Patent
Kuhe et al.

(10) Patent No.: US 10,856,709 B2
(45) Date of Patent: Dec. 8, 2020

(54) EVACUATION STATION SYSTEM

(71) Applicant: iRobot Corporation, Bedford, MA (US)

(72) Inventors: Tucker Kuhe, Acton, MA (US); Jennifer Smith, Beverly, MA (US); Sam Duffley, Billerica, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 15/858,912

(22) Filed: Dec. 29, 2017

(65) Prior Publication Data

US 2018/0125312 A1 May 10, 2018

Related U.S. Application Data

(63) Continuation of application No. 14/634,170, filed on Feb. 27, 2015, now Pat. No. 9,888,818, which is a continuation of application No. 13/345,270, filed on Jan. 6, 2012, now Pat. No. 8,984,708.

(60) Provisional application No. 61/430,896, filed on Jan. 7, 2011.

(51) Int. Cl.

| | |
|---|---|
| ***A47L 5/24*** | (2006.01) |
| ***A47L 11/40*** | (2006.01) |
| ***A47L 11/33*** | (2006.01) |
| ***A47L 9/10*** | (2006.01) |

(52) U.S. Cl.

CPC ..... *A47L 5/24* (2013.01); *A47L 11/33* (2013.01); *A47L 11/4025* (2013.01); *A47L 9/106* (2013.01); *A47L 2201/02* (2013.01); *A47L 2201/024* (2013.01)

(58) Field of Classification Search

CPC ..... A47L 5/24; A47L 9/106; A47L 11/4025; A47L 11/33; A47L 2201/02; A47L 2201/024

See application file for complete search history.

(56) References Cited

U.S. PATENT DOCUMENTS

| | | | |
|---|---|---|---|
| 1,417,768 | A | 5/1922 | Radimak |
| 2,770,825 | A | 11/1956 | Pullen |
| 2,868,321 | A | 1/1959 | Kelly |
| 2,892,511 | A | 6/1959 | Gall et al. |

(Continued)

FOREIGN PATENT DOCUMENTS

| | | |
|---|---|---|
| DE | 4414683 | 10/1995 |
| DE | 10242257 | 4/2003 |

(Continued)

OTHER PUBLICATIONS

[No Author Listed], "DEEBOT D77 Instruction Manual," ECOVACS Robotics, Inc., 2013, 20 pages.

(Continued)

*Primary Examiner* — David Redding

(74) *Attorney, Agent, or Firm* — Fish & Richardson P.C.

(57) ABSTRACT

A cleaning system includes a robotic cleaner and an evacuation station. The robotic cleaner can dock with the evacuation station to have debris evacuated by the evacuation station. The robotic cleaner includes a bin to store debris, and the bin includes a port door through which the debris can be evacuated into the evacuation station. The evacuation station includes a vacuum motor to evacuate the bin of the robotic cleaner.

26 Claims, 19 Drawing Sheets

(56) References Cited

U.S. PATENT DOCUMENTS

| | | | | |
|---|---|---|---|---|
| 3,863,285 | A | 2/1975 | Hukuba | |
| 4,118,208 | A | 10/1978 | Klinedinst | |
| 4,756,049 | A * | 7/1988 | Uehara | A47L 7/008 15/312.1 |
| 5,345,649 | A | 9/1994 | Whitlow | |
| 5,646,494 | A | 7/1997 | Han | |
| 5,740,581 | A | 4/1998 | Harrelson, II | |
| 5,787,545 | A | 8/1998 | Colens | |
| 5,926,909 | A | 7/1999 | McGee | |
| 5,959,423 | A | 9/1999 | Nakanishi et al. | |
| 5,995,884 | A | 11/1999 | Allen et al. | |
| 6,076,226 | A | 6/2000 | Reed | |
| 6,094,775 | A | 8/2000 | Behmer | |
| 6,272,712 | B1 | 8/2001 | Gockel et al. | |
| 6,615,446 | B2 | 9/2003 | Noreen et al. | |
| 6,712,868 | B2 | 3/2004 | Murphy et al. | |
| 6,748,297 | B2 * | 6/2004 | Song | A47L 9/2805 15/319 |
| 6,764,373 | B1 | 7/2004 | Osawa et al. | |
| 6,957,712 | B2 | 10/2005 | Song et al. | |
| 7,201,786 | B2 | 4/2007 | Wegelin et al. | |
| 7,412,748 | B2 | 8/2008 | Lee et al. | |
| 7,729,801 | B2 | 6/2010 | Abramson | |
| 7,779,504 | B2 | 8/2010 | Lee et al. | |
| 7,849,555 | B2 | 12/2010 | Hahm et al. | |
| 8,572,799 | B2 * | 11/2013 | Won | A47L 9/106 15/319 |
| 8,984,708 | B2 | 3/2015 | Kuhe et al. | |
| 9,888,818 | B2 | 2/2018 | Kuhe et al. | |
| 2002/0124343 | A1 | 9/2002 | Reed | |
| 2004/0255425 | A1 * | 12/2004 | Arai | A47L 9/2857 15/300.1 |
| 2005/0015920 | A1 | 1/2005 | Kim et al. | |
| 2005/0183229 | A1 | 8/2005 | Uehigashi | |
| 2006/0037170 | A1 | 2/2006 | Shimizu | |
| 2007/0157415 | A1 | 7/2007 | Lee et al. | |
| 2007/0157420 | A1 | 7/2007 | Lee et al. | |
| 2007/0226949 | A1 | 10/2007 | Hahm et al. | |
| 2007/0245511 | A1 | 10/2007 | Hahm et al. | |
| 2008/0052846 | A1 | 3/2008 | Kapoor et al. | |
| 2008/0161969 | A1 | 7/2008 | Lee et al. | |
| 2009/0049640 | A1 | 2/2009 | Lee et al. | |
| 2010/0011529 | A1 | 1/2010 | Won et al. | |
| 2010/0107355 | A1 | 5/2010 | Won et al. | |
| 2010/0263142 | A1 | 10/2010 | Jones et al. | |
| 2015/0223651 | A1 | 8/2015 | Kuhe et al. | |

FOREIGN PATENT DOCUMENTS

| | | |
|---|---|---|
| DE | 102004-041021 | 8/2005 |
| EP | 1243218 | 9/2002 |
| EP | 1806086 | 7/2007 |
| ES | 2238196 | 8/2005 |
| GB | 381622 | 10/1932 |
| GB | 449815 | 7/1936 |
| GB | 702426 | 1/1954 |
| JP | 2001212052 | 8/2001 |
| JP | 2001321308 | 11/2001 |
| JP | 2003-180587 | 7/2003 |
| JP | 2004283327 | 10/2004 |
| JP | 2005124753 | 5/2005 |
| JP | 2005204909 | 8/2005 |
| KR | 2003016807 | 3/2003 |
| KR | 657736 | 12/2006 |
| KR | 2007103248 | 10/2007 |
| KR | 2007112908 | 11/2007 |
| KR | 2009019480 | 2/2009 |
| WO | WO 2005/027704 | 3/2005 |
| WO | WO 2005/055795 | 6/2005 |
| WO | WO 2007/088192 | 8/2007 |
| WO | WO 2007/137234 | 11/2007 |
| WO | WO 2012/094617 | 7/2012 |

OTHER PUBLICATIONS

Extended European Search Report issued in EP Application No. 14186135.1, dated Jan. 20, 2015, 7 pages.

International Preliminary Report on Patentability issued in International Application No. PCT/US2012/020520, dated Jul. 18, 2013, 11 pages.

International Search Report and Written Opinion issued in International Application No. PCT/US2012/020520, dated Jan. 6, 2012, 23 pages.

Karcher RC 3000 Robotic Cleaner, Product page, accessed online <http://www.karcher-usa.com/showproducts.php?op=view_prod &param1=143&param2=&param3=> Mar. 18, 2005, 3 pages.

Karcher RoboCleaner RC 3000, Dec. 12, 2003, 4 pages.

Karcher, Product Manual Download, 2003, 16 pages.

Schroder, "Schwierige Beschaffung," Maschinenmarket, Wurzburg, 105 (1999), 27, 11 pages (English Tranlsation).

* cited by examiner

EVACUATION STATION SYSTEM

CROSS-REFERENCE TO RELATED APPLICATIONS

This application is a continuation of and claims priority to U.S. application Ser. No. 14/634,170, filed Feb. 27, 2015, titled "EVACUATION STATION SYSTEM," which is a continuation of and claims priority to U.S. application Ser. No. 13/345,270, filed Jan. 6, 2012, entitled "EVACUATION STATION SYSTEM," which claims priority to U.S. Provisional Application Ser. No. 61/430,896, filed Jan. 7, 2011, titled "EVACUATION STATION SYSTEM," the entire contents of which are hereby incorporated by reference.

TECHNICAL FIELD

This disclosure relates to cleaning systems for coverage robots.

BACKGROUND

Autonomous robots are robots which can perform desired tasks in unstructured environments without continuous human guidance. Many kinds of robots are autonomous to some degree. Different robots can be autonomous in different ways. An autonomous coverage robot traverses a work surface without continuous human guidance to perform one or more tasks. In the field of home, office and/or consumer-oriented robotics, mobile robots that perform household functions such as vacuum cleaning, floor washing, lawn cutting and other such tasks have become commercially available.

SUMMARY

In general, one aspect of the subject matter described in this specification can be embodied in a cleaning system comprising: a portable vacuum including a vacuum motor, a cleaning head, an evacuation port, and a bypass mechanism configured to direct suction from the vacuum motor to either the cleaning head or the evacuation port; a robotic cleaner including a debris bin and an evacuation port assembly for the debris bin; and an evacuation station including a vacuum interface configured to mate with the portable vacuum, a cleaner interface configured to mate with the robotic cleaner, and a linkage connecting the evacuation port assembly of the debris bin and the evacuation port of the portable vacuum, wherein the evacuation station is configured to engage the bypass mechanism on mating with the portable vacuum to direct suction from the vacuum motor to the evacuation port.

These and other embodiments can each optionally include one or more of the following features. The cleaner interface includes an evacuation connector formed of compliant material coupled to the linkage. The evacuation connector is generally rectangular and defines a hole through which air and debris can flow into the linkage. The evacuation connector is configured to move with one degree of freedom. The evacuation connector is curved and configured to mate with a spherical shell of the robotic cleaner. The evacuation connector includes a poker configured to engage a port door of the evacuation port assembly. The poker includes a reed switch coupled to a controller of the portable vacuum, and wherein the port door includes a magnet. The port door is configured to form a seal that is substantially air tight when not in contact with the poker. The debris bin includes a microprocessor and a serial connection to the robotic cleaner. The debris bin includes a navigational sensor coupled to the microprocessor. The microprocessor is configured to communicate a bin full signal to the robotic cleaner using the serial connection. The microprocessor is configured to communicate a navigational signal to the robotic cleaner using the serial connection. The robotic cleaner includes an omnidirectional navigational sensor on a forward end opposite the debris bin and bin sensor on the debris bin. The bin sensor is configured to receive omnidirectionally, within 180 degrees, or within 90 degrees.

In general, another aspect of the subject matter described in this specification can be embodied in a method performed by a robotic cleaner for evacuation a debris bin of the robotic cleaner, the method comprising: determining a bin full event has occurred; navigating to an evacuation station; docking front-first at the evacuation station, wherein a front of the robotic cleaner is substantially opposite the debris bin; backing out of the evacuation station and rotating approximately 180 degrees; docking bin-first at the evacuation station; and waiting while the evacuation station vacuums debris from the debris bin for an amount of time.

These and other embodiments can each optionally include one or more of the following features. The method further comprises driving away from the evacuation station. The method further comprises determining that a battery is low on charge, driving away from the evacuation station, rotating 180 degrees, and docking front-first at the evacuation station to contact at least one electrical charging contact. Determining a bin full event has occurred includes receiving a bin full signal from the debris bin. The bin full signal is based on input from debris sensors in the debris bin. Docking bin-first at the evacuation station comprises using a navigational sensor on the debris bin.

In general, another aspect of the subject matter described in this specification can be embodied in a cleaning system comprising: an evacuation station including a portable vacuum; a robotic cleaner; a bin in the robotic cleaner configured to collect debris, the bin including a port door; and an evacuation connector coupled to an evacuation chamber of the evacuation station, the evacuation connector configured to open the port door on the bin of the robotic cleaner when the robotic cleaner drives into the evacuation station; wherein the bin includes a downwardly extending baffle behind the port door, the baffle being configured to direct evacuating suction from the portable vacuum of the evacuation station downwardly to reach a bottom of the bin.

These and other embodiments can each optionally include one or more of the following features. The bin includes vertical side wall next to the baffle and the port door, and the baffle is configured to direct evacuating suction along the vertical side wall. The bin includes a filter next to the baffle, the filter being configured to block debris from flowing into a vacuum fan and to allow debris to accumulate at the bottom of the bin. The bin includes a bevel on the bottom of the bin, and the baffle is configured to direct the evacuating suction across the bevel to the bottom of the bin. The evacuation connector is configured to rotate about a pivot as the robotic cleaner docks with the evacuation station.

In general, another aspect of the subject matter described in this specification can be embodied in a robotic cleaner comprising: a drive system configured to move the robotic cleaner about a coverage area; a vacuum motor to collect debris from the coverage area; and a bin to store collected debris from the coverage area, the bin comprising: an exhaust vent for the vacuum motor; a filter between the vacuum motor and a bottom of the bin; a port door next to the exhaust vent for evacuating the bin; a vertical side wall;

and a downwardly extending baffle behind the port door, the baffle being configured to direct evacuating suction downwardly along the vertical side wall to reach the bottom of the bin.

These and other embodiments can each optionally include one or more of the following features. The bin includes a bevel on the bottom of the bin, and the baffle is configured to direct the evacuating suction across the bevel to the bottom of the bin. The baffle is curved along a direction from the filter to the vertical side wall. The port door is configured to rotate so that when the port door is open part of the port door recedes into a pocket volume. The bin further comprises a spring configured to hold the port door closed until engaged by a poker of an evacuating connector.

Particular embodiments of the subject matter described in this specification can be implemented so as to realize one or more of the following advantages. A robotic cleaner can empty a bin holding debris without human interaction. The robotic cleaner can cover larger coverage areas without requiring a larger bin by emptying its bin. The bin can be emptied into a portable vacuum, for example, that can provide evacuating suction and be conveniently emptied. The bin includes features, for example a baffle and a bevel, that route evacuating suction to the bottom of the bin where debris accumulates.

DESCRIPTION OF DRAWINGS

Like reference symbols in the various drawings indicate like elements.

DETAILED DESCRIPTION

Figure 1:
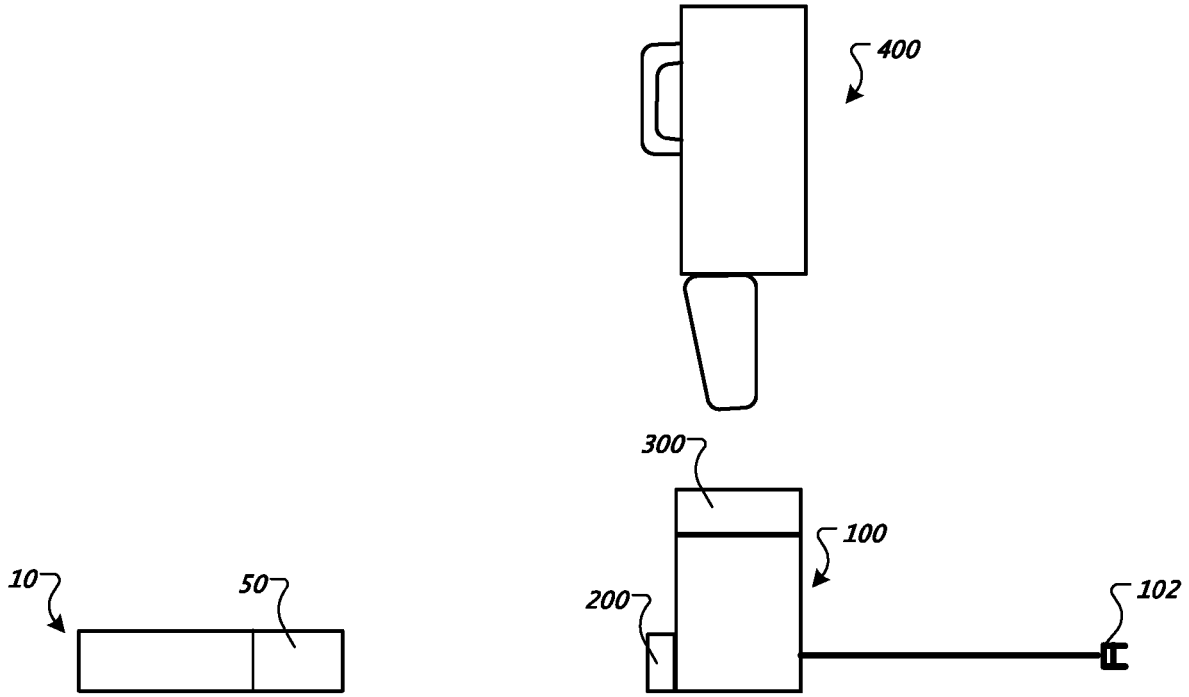
FIGS. 1-2 illustrate a cleaning system including a robotic cleaner, an evacuation station, and a portable vacuum.
Figure 2:
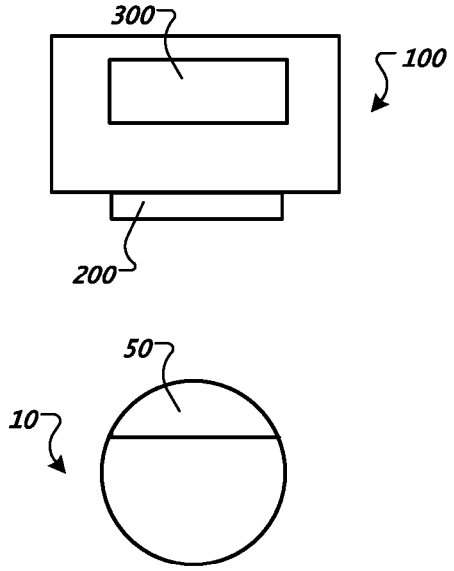

FIGS. 1-2 illustrate a cleaning system including a robotic cleaner 10, an evacuation station 100, and a portable vacuum 400. FIG. 1 is a schematic side view of the system. FIG. 2 is a schematic overhead view of the system.

The robotic cleaner 10 includes a bin 50. While cleaning, the robotic cleaner 10 collects debris in the bin 50. When the robotic cleaner 10 detects that the bin 50 is full, the robotic cleaner 10 navigates to the evacuation station 100. The robotic cleaner docks with a cleaner interface 200 to the evacuation station 100. The portable vacuum 400 connects to the evacuation station using a vacuum interface 300. The portable vacuum 400 provides suction and/or airflow to remove debris from the robotic cleaner's bin 50. The portable vacuum 400 stores the removed debris. Evacuating the robotic cleaner's bin into the portable vacuum 400 is useful, for example, because the robotic cleaner can operate without human intervention for longer periods of time.

The evacuation station 100 may be connected to an AC power source, e.g., by a power cord 102. The evacuation station 100 may charge a battery on the robotic cleaner 10 through the cleaner interface 200. The evacuation station 100 may also provide and receive control signals with the robotic cleaner 10 through the cleaner interface (e.g., a signal to begin evacuation).

The evacuation station 100 may charge a battery on the portable vacuum 400 through the vacuum interface 300. The evacuation station 100 may provide AC power to the portable vacuum 400 through the vacuum interface 300. The evacuation station 100 may provide and receive control signals (e.g., a signal to begin evacuation) with the portable vacuum 400 through the vacuum interface 300.

The portable vacuum 400 may be a handheld vacuum cleaner. The portable vacuum 400 may be a hip pack or backpack vacuum. For example, the portable vacuum 400 may be designed to be carried by rigorous supports, e.g., supports used for hiking and the like.

Figure 3A:
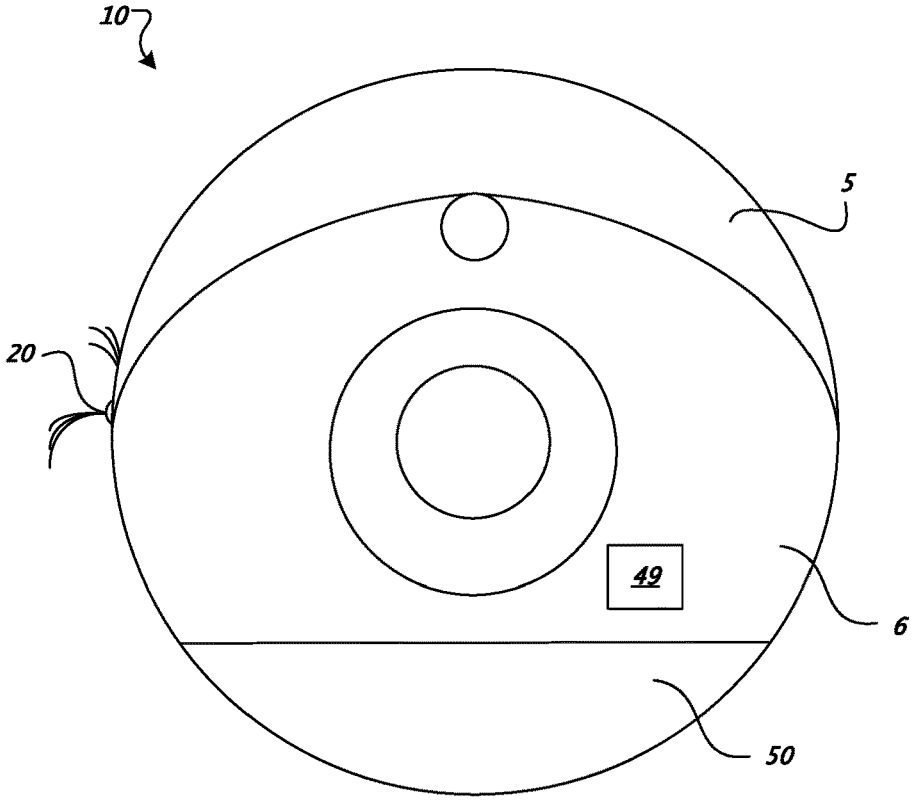
FIGS. 3A-3B illustrate an example robotic cleaner.
Figure 3B:
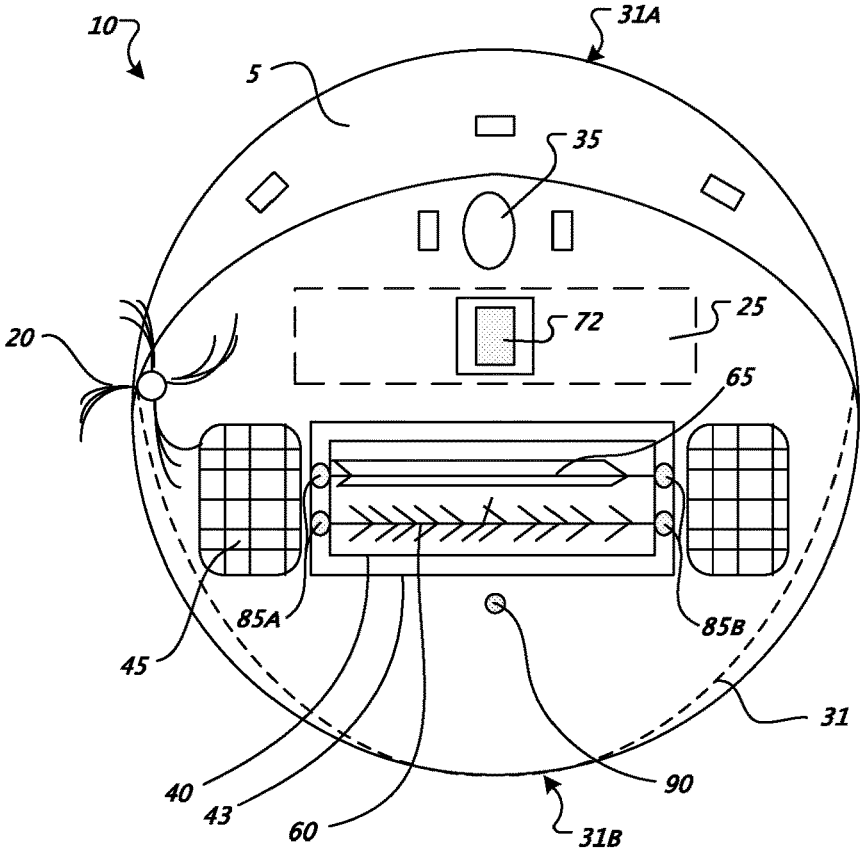

FIGS. 3A-3B illustrate an example robotic cleaner 10. The robotic cleaner 10 includes a chassis 31 which carries an outer shell 6. FIG. 3A illustrates the outer shell 6 of the robot 10 connected to a bumper 5. The robot 10 may move in forward and reverse drive directions; consequently, the chassis 31 has corresponding forward and back ends, 31A and 31B respectively. The forward end 31A is fore in the direction of primary mobility and in the direction of the bumper 5; the robot 10 typically moves in the reverse direction primarily during escape, bounces, and obstacle avoidance. A cleaning head assembly 40 is located towards the middle of the robot 10 and installed within the chassis 31. The cleaning head assembly 40 includes a main brush 60 and a secondary parallel brush 65 (either of these brushes may be a pliable multi-vane beater or a have pliable beater flaps 61 between rows of brush bristles 62). A battery 25 is housed within the chassis 31 proximate the cleaning head 40. In some examples, the main 65 and/or the secondary parallel brush 60 are removable. In other examples, the cleaning head assembly 40 includes a fixed main brush 65 and/or secondary parallel brush 60, where fixed refers to a brush permanently installed on the chassis 31.

Installed along either side of the chassis 31 are differentially driven wheels 45 that mobilize the robot 10 and provide two points of support. The forward end 31A of the chassis 31 includes a caster wheel 35 which provides additional support for the robot 10 as a third point of contact with the floor and does not hinder robot mobility. Installed along the side of the chassis 31 is a side brush 20 configured to rotate 360 degrees when the robot 10 is operational. The rotation of the side brush 20 allows the robot 10 to better clean areas adjacent the robot's side by brushing and flicking debris beyond the robot housing in front of the cleaning path, and areas otherwise unreachable by the centrally located cleaning head assembly 40. A removable cleaning bin 50 is located towards the back end 31B of the robot 10 and installed within the outer shell 6.

Figure 3C:
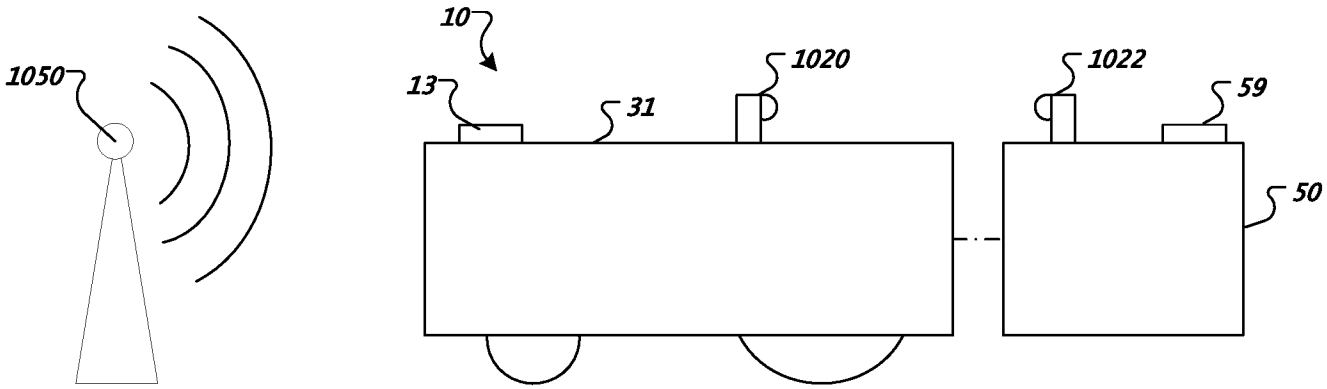
FIG. 3C is a schematic diagram of an example robotic cleaner including a bin navigation sensor on a bin.

FIG. 3C is a schematic diagram of an example robotic cleaner 10 including a bin navigation sensor 59 on a bin 50. In some implementations, the robot 10 includes a receiver 1020 (e.g., an infrared receiver) and the bin 50 includes a corresponding emitter 1022 (e.g., an infrared emitter). The emitter 1022 and receiver 1020 are positioned on the bin 50 and robot 10, respectively, such that a signal transmitted from the emitter 1022 reaches the receiver 1020 when the bin 50 is attached to the robot 10. For example, in implementations in which the receiver 1020 and the remitter 1022 are infrared, the emitter 1022 and the receiver 1020 are positioned relative to one another to facilitate line-of-sight communication between the emitter 1022 and the receiver 1020. In some examples, the emitter 1022 and the receiver 1020 both function as emitters and receivers, allowing bi-directional communication between the robot 11 to the bin 50.

In some examples, the robot 10 includes an omni-directional receiver 13 on the chassis 31 and configured to interact with a remote virtual wall beacon 1050 that emits and receives infrared signals. A signal from the emitter 1022 on the bin 50 can be receivable by the omni-directional receiver 13 and/or the remote virtual wall beacon 1050 to communicate, e.g., a bin fullness signal, or navigational signals from a bin navigation sensor 59. While infrared communication between the robot 10 and the bin 50 has been described, one or more other types of wireless communication may additionally or alternatively be used to achieve such wireless communication. Examples of other types of wireless communication between the robot 10 and the bin 50 include electromagnetic communication and radiofrequency communication.

The bin fullness signal can trigger the robot 10 to navigate to an evacuation station to empty debris from the bin 10. The robot 10 may use the bin navigation sensor 59 to dock with an evacuation station, e.g., when the robot 10 is docking bin-first so that the bin faces the evacuation station. The bin navigation sensor 59 may be an omnidirectional sensor, e.g., an omnidirectional infrared receiver. Alternatively, the bin navigation sensor 59 may be a 90 degree sensor or a 180 degree sensor.

Figure 4A:
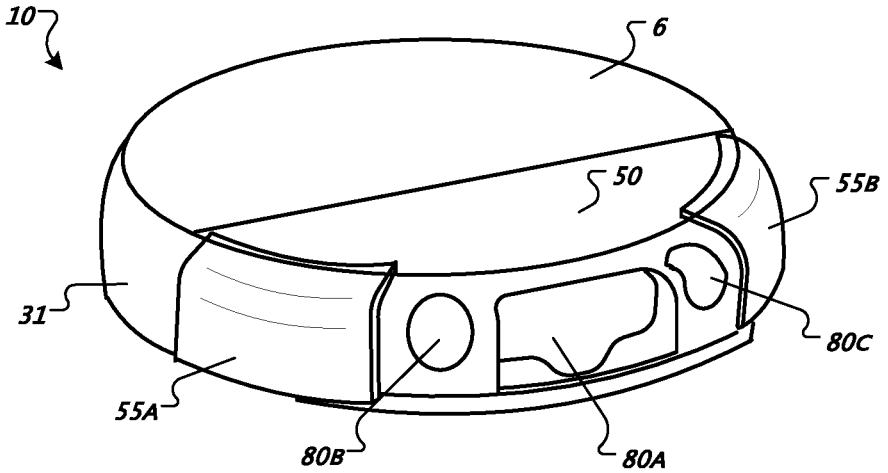
FIG. 4A is a perspective view of an example robotic cleaner showing an evacuation port assembly of the cleaning bin.

FIG. 4A is a perspective view of an example robotic cleaner 10 showing an evacuation port assembly 80 of the cleaning bin 50. The evacuation port assembly 80 may include a port cover 55. In some implementations, the port cover 55 includes a panel or panels 55A, 55B which may slide (or be otherwise translated) along a side wall of the chassis 31 and under or over side panels of the outer shell 6 to open the evacuation port assembly 80. The evacuation port assembly 80 is configured to mate with the cleaner interface 200 of the evacuation station 100. In some implementations, the evacuation port assembly 80 is installed along an edge of the outer shell 6, on a top most portion of the outer shell 6, on the bottom of the chassis 31, or other similar placements where the evacuation port assembly 80 has ready access to the contents of the cleaning bin 50. In some implementations, the evacuation port assembly 80 includes a single evacuation port 80A. In some implementations, the evacuation port assembly 80 includes a plurality of evacuation ports 80A, 80B, 80C that are distributed across the cleaning bin 50.

Figure 4B:
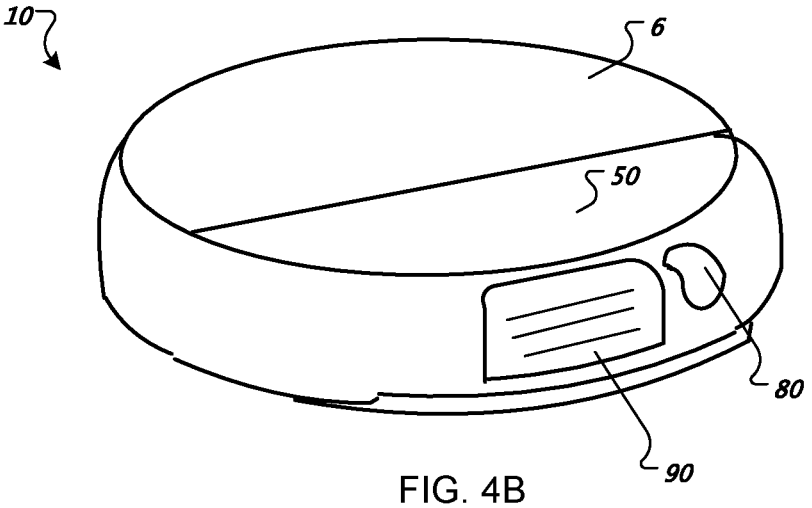
FIG. 4B is a perspective view of an example robotic cleaner showing an alternative evacuation port assembly of the cleaning bin.

FIG. 4B is a perspective view of an example robotic cleaner showing an alternative evacuation port assembly 80 of the cleaning bin 50. In FIG. 4B, the evacuation port assembly 80 is offset from the center of the rear of the bin 50. An outlet 90, e.g., of a vacuum, occupies the center of the rear of the bin 50. The evacuation port assembly 80 may include a spring loaded door, e.g., a port door on a hinge. In some implementations, the port door opens at the bottom when a poker engages the top of the port door.

Figure 5:
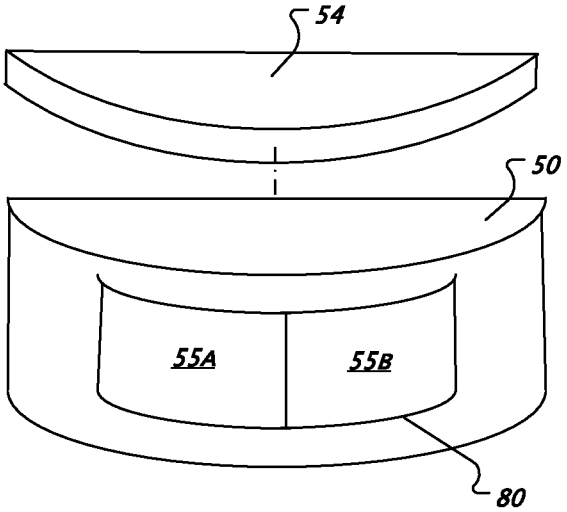
FIG. 5 is a schematic diagram of an example removable cleaning bin.

FIG. 5 is a schematic diagram of an example removable cleaning bin 50. The cleaning bin 50 may be removable from the chassis 31 to provide access to bin contents and an internal filter 54.

Figure 6A:
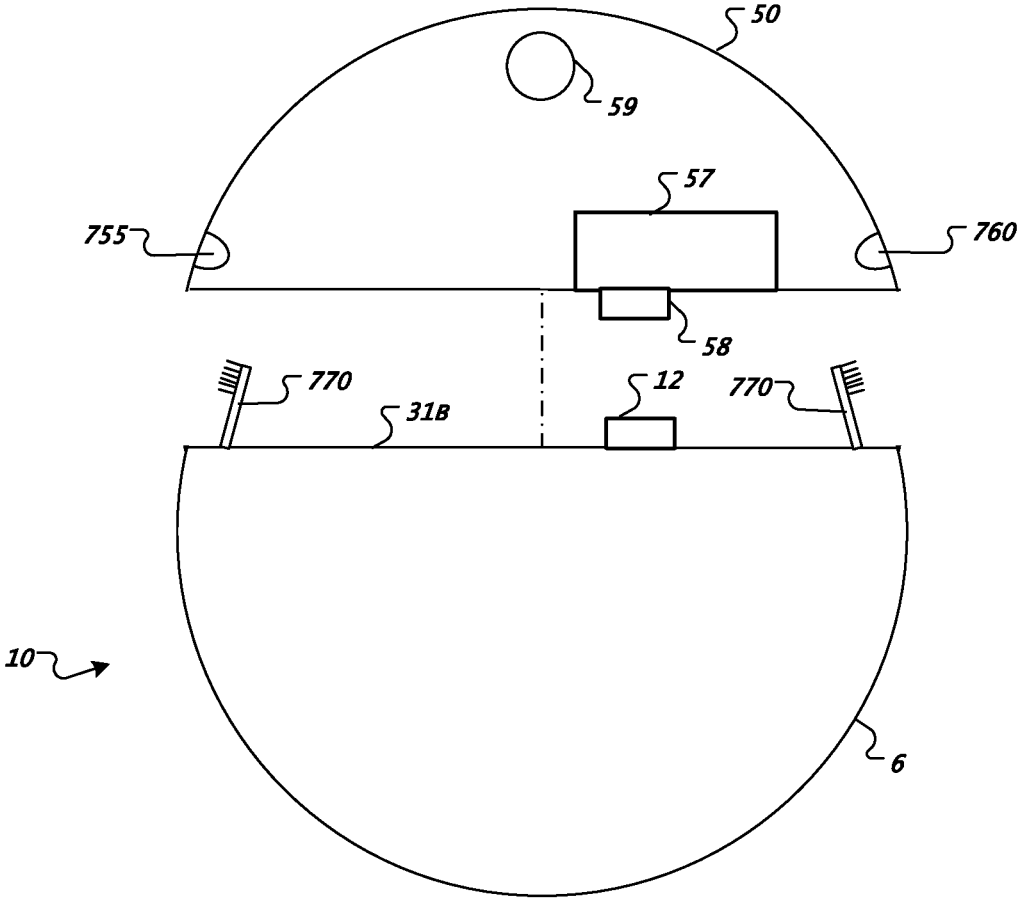
FIGS. 6A-6B illustrate a bin-full detection system for sensing an amount of debris present in the bin.
Figure 6B:
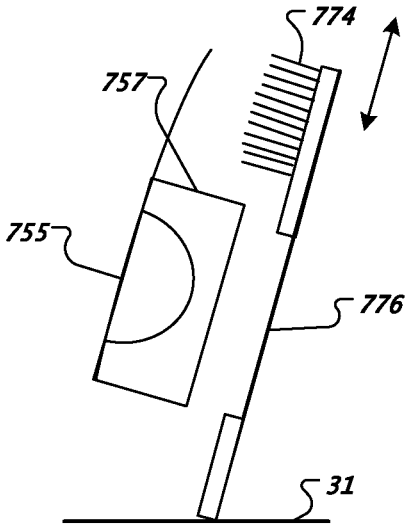
Figure 7A:
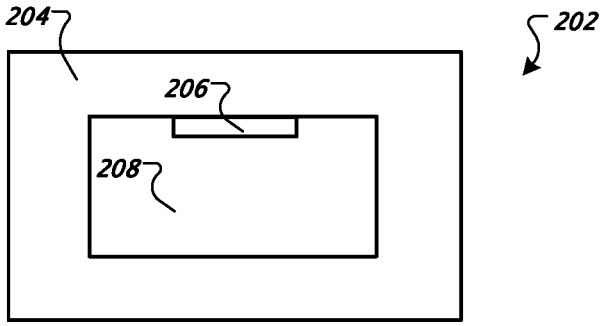
FIGS. 7A-7D are front, side, top, and perspective views of an evacuation connector.
Figure 7B:
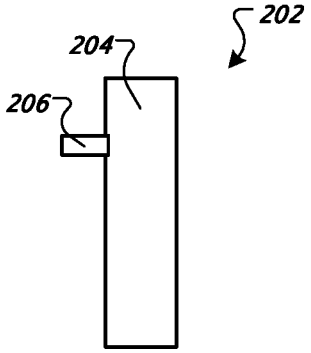
Figure 7C:
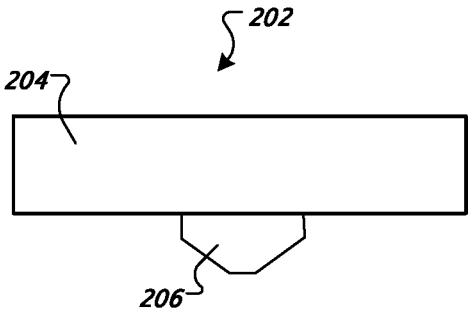
Figure 7D:
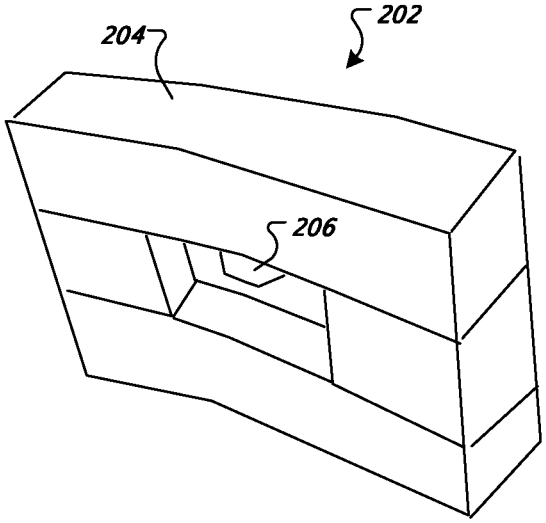

FIGS. 6A-6B illustrate a bin-full detection system for sensing an amount of debris present in the bin 50. The bin-full detection system includes an emitter 755 and a detector 760 housed in the bin 50. A housing 757 surrounds each of the emitter 755 and the detector 760 and is substantially free from debris when the bin 50 is also free of debris. In some implementations, the bin 50 is detachably connected to the robotic cleaner 11 and includes a brush assembly 770 for removing debris and soot from the surface of the emitter/detector housing 757. The brush assembly 770 includes a brush 772 mounted on the robot body 31 and configured to sweep against the emitter/detector housing 757 when the bin 50 is removed from or attached to the robot 11. The brush 772 includes a cleaning head 774 (e.g. bristles or sponge) at a distal end farthest from the robot 11 and a window section 776 positioned toward a base of the brush 772 and aligned with the emitter 755 or detector 760 when the bin 50 is attached to the robot 11. The emitter 755 transmits and the detector 760 receives light through the window 776. In addition to brushing debris away from the emitter 755 and detector 760, the cleaning head 774 reduces the amount of debris or dust reaching the emitter 755 and detector 760 when the bin 50 is attached to the robot 11. In some examples, the window 776 comprises a transparent or translucent material and is formed integrally with the cleaning head 774. In some examples, the emitter 755 and the detector 760 are mounted on the chassis 31 of the robot 11 and the cleaning head 774 and/or window 776 are mounted on the bin 50.

In some implementations, the bin 50 includes a microprocessor 57. For example, the microprocessor may be connected to the emitter and detector 755 and 760 to execute an algorithm to determine whether the bin is full. The microprocessor may also be connected to a bin navigation sensor 59. The microprocessor 57 may communicate with the robotic cleaner 10 from a bin serial port 58 to a robot serial port 12. The serial ports 58 and 12 may be, for example, mechanical terminals or optical devices. For example, the microprocessor 57 may report bin full events to the robotic cleaner 10, or report a signal that the robotic cleaner has docked (e.g., based on signals from the bin navigation sensor 59), or report other events from the bin navigation sensor 59.

FIGS. 7A-7D are front, side, top, and perspective views of an evacuation connector 202. The cleaner interface 200 includes the evacuation connector 202. The evacuation connector 202 is formed of compliant material, e.g., any of various types of foams, elastomers, or rubbers. In implementations where the evacuation connector 202 is formed of foam, the evacuation connector 202 can include harder and softer layers, e.g., with the softer layer on the outside for contacting a robotic cleaner 10. The foam can have a durometer in the range of foam used for weatherstripping.

The evacuation connector 202 defines a hole 208 through which air and debris can flow between the robotic cleaner 10 and an evacuation station 100. For example, the evacuation connector 202 may be rectangular, as is shown in FIGS. 7A-7D. The evacuation connector 202 may be formed of rectangular pieces of the compliant material stacked on top of each other. The evacuation connector 202 may be curved to improve mating with a circular robotic cleaner. The evacuation connector 202 includes a poker 206 that is configured to open an evacuation port assembly 80 for evacuation.

Figure 8A:
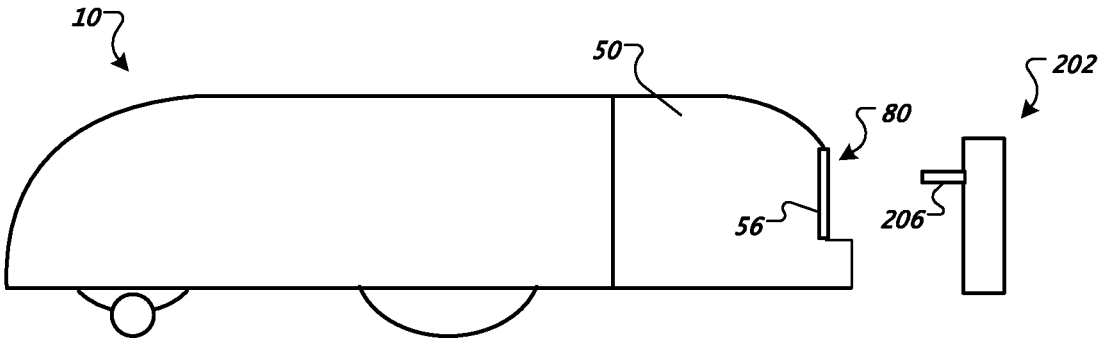
FIGS. 8A-8B are schematic diagrams illustrating a robotic cleaner docking to connect to an evacuation connector.
Figure 8B:
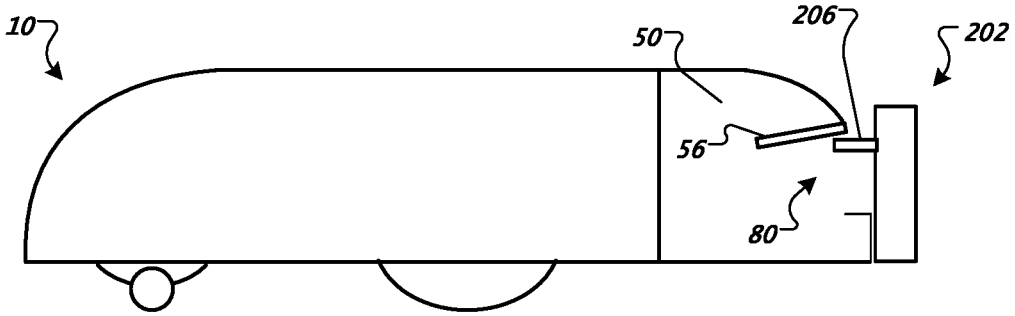

FIGS. 8A-8B are schematic diagrams illustrating a robotic cleaner 10 docking to connect to an evacuation connector 202. The robot 10 is guided or aligned so that the evacuation port assembly 80 on the robot cleaning bin 50 engages the evacuation connector 202. The robot 10 may be guided by a homing signal, tracks on a platform, guide rails, a lever, or other guiding devices. The evacuation connector 202 opens a port door 56 on the robot cleaning bin 50 when the robot 10 docks.

The port door 56 is configured to be substantially airtight when closed, e.g., as shown in FIG. 8A. The port door 56 and evacuation port assembly 80 are configured to be evacuable when opened, e.g., as shown in FIG. 8B. For example, the evacuation port assembly 80 may include a baffle to shape airflow within the bin 50 during evacuation. The baffle and evacuation port assembly 80 create an airflow channel from the top of the bin 50 to the bottom of the bin 50, even though the bin evacuates from the evacuation port assembly 80 which is on the side of the bin. This is useful, for example, so that bin 50 more completely empties of debris during evacuation. In some implementations, the bin 50 is a joint sweeping-vacuuming bin.

In some implementations, the evacuation port assembly 80 and evacuation connector 202 are configured to signal an evacuation station 100 to begin evacuation when the evacuation port assembly 80 mates with the evacuation connector 202. For example, the port door 56 may include one or more magnets, and the poker 206 of the evacuation connector 202 may include one or more reed switches. The reed switches may be connected to a controller on the evacuation station 100 or directly to a portable vacuum 400. In general, the evacuation port assembly 80 includes a passive element that does not draw power and can signal the evacuation connector 202. The evacuation connector 202 includes a receiver to match the passive element. The receiver may be, for example, a reed switch, a Hall effect receiver, a photointerruptor, or the like.

Figure 9:
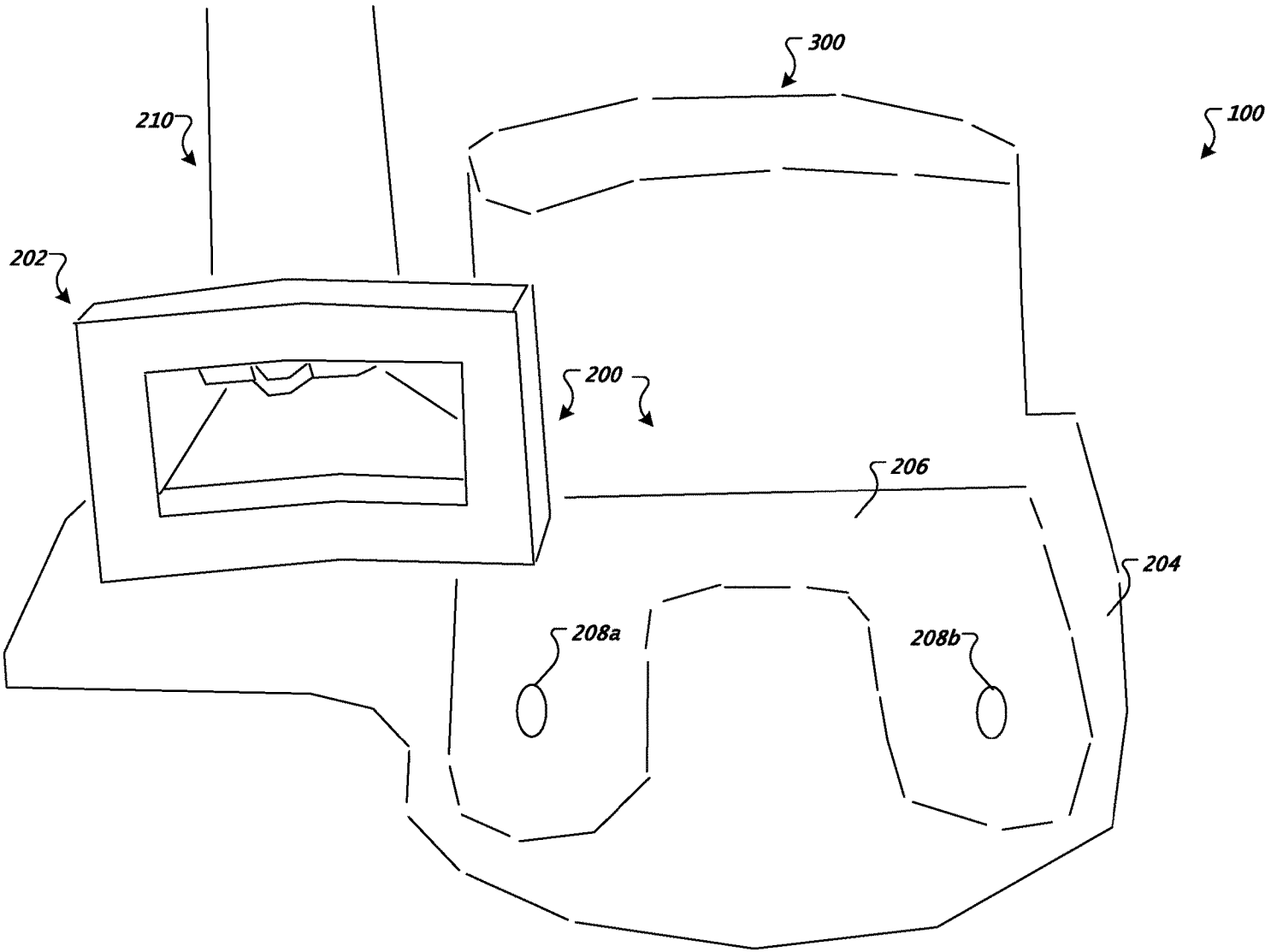
FIG. 9 illustrates an example evacuation station.

FIG. 9 illustrates an example evacuation station 100. The evacuation station 100 includes a cleaner interface 200 and a vacuum interface 300. The cleaner interface includes an evacuation connector 202. The evacuation connector 202 empties into an air chamber 210 configured to connect to a vacuum. In some implementations, the evacuation connector 202 has one or more degrees of freedom of movement. For example, the evacuation connector 202 may be mounted on a swivel or hinge. The evacuation connector 202 is then free to move from side to side to form a better seal with a curved plane, e.g., on a robotic cleaner 10.

The cleaner interface also includes a lower platform 204 and an upper platform 206 for receiving a robotic cleaner 10. The upper platform 206 is raised compared to the lower platform, for example, to assist the robotic cleaner 10 in docking with the evacuation station 100. The upper platform 206 includes two electrical contacts 208*a* and 208*b*. The electrical contacts 208*a* and 208*b* are useful, for example, to charge the robotic cleaner 10, to guide the robotic cleaner 10 (e.g., indicate when the robotic cleaner 10 is docked), or both.

In some implementations, the electrical contacts 208*a* and 208*b* are positioned to align with the electrical contacts on the robotic cleaner 10 when the robotic cleaner 10 docks front-first, so that the bin 50 of the robotic cleaner faces away from the evacuation station 100. The robotic cleaner 10 then charges while docked front-first. The evacuation connector 202 is position to align with the evacuation port assembly 80 when the robot docks bin-first, so that the bin 50 of the robot cleaner faces the evacuation station 100. When the robotic cleaner 10 docks bin-first, the evacuation station evacuates the bin 50.

Figure 10:
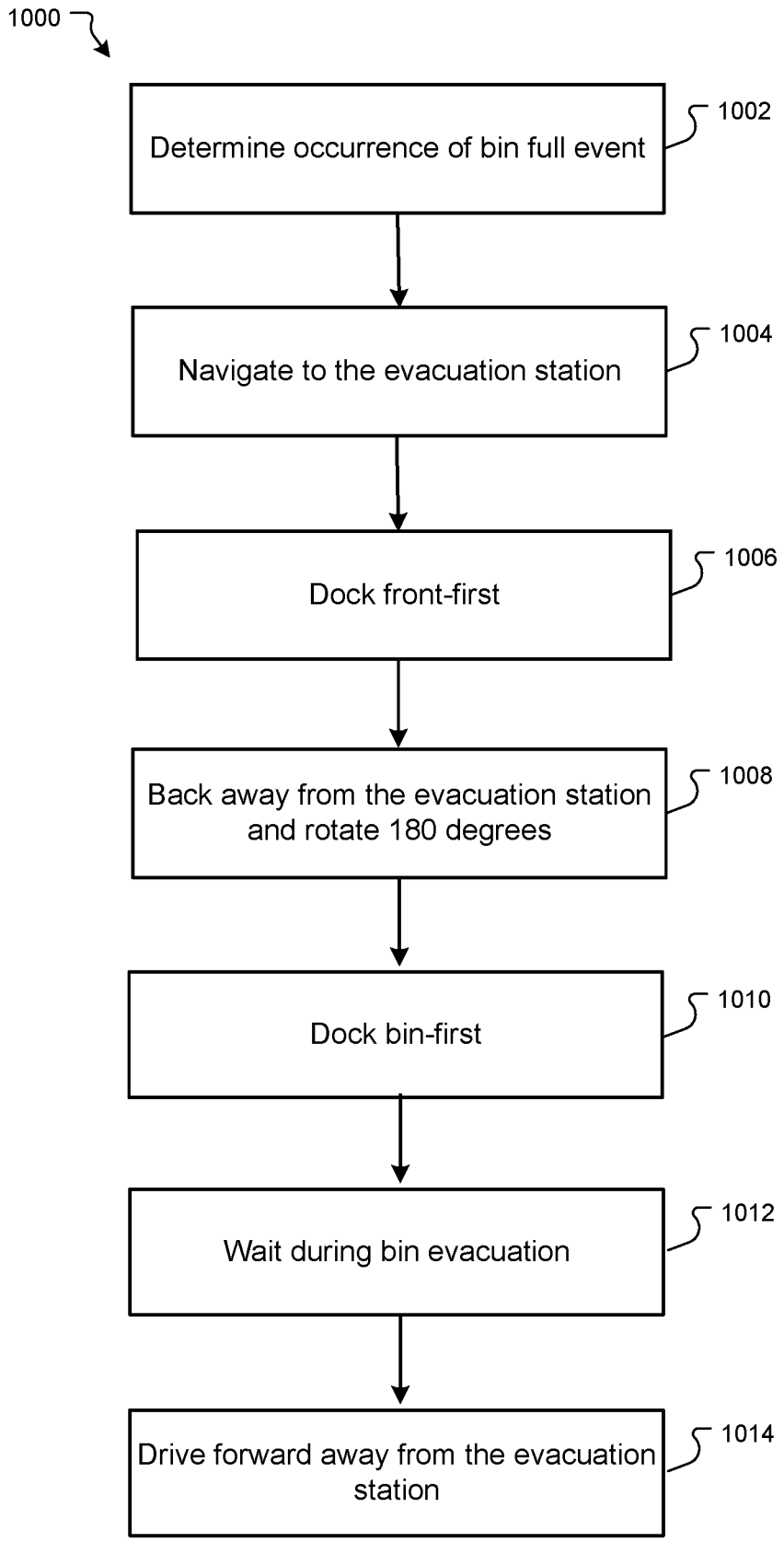
FIG. 10 is a flow diagram of an example process for evacuating a bin of a robotic cleaner.

FIG. 10 is a flow diagram of an example process 1000 for evacuating a bin of a robotic cleaner. The process 1000 is performed by the robotic cleaner. The robotic cleaner may be, for example, the robotic cleaner 10 of FIGS. 3A and 3B including the bin 50 of FIG. 5.

The robotic cleaner determines that a bin full event has occurred (step 1002). For example, the robotic cleaner may receive a bin full signal from a bin as described above with reference to FIGS. 6A-6B.

The robotic cleaner navigates to an evacuation station (step 1004). The robotic cleaner may use various methods of navigation, and may need to traverse a household to reach the evacuation station.

The robotic cleaner docks to the evacuation station front-first (step 1006). For example, the robotic cleaner may use a front-facing omnidirectional sensor (e.g., the sensor 13 of FIG. 3C) to properly align with the evacuation station. The robotic cleaner may also use electrical contacts (e.g., the electrical contacts 208*a* and 208*b* of FIG. 9) to align itself with the evacuation station. The robotic cleaner docks front-first, for example, because it has a better sensor in the front or its contacts are designed to contact the evacuation station during front-first docking. Thus, the robotic cleaner can align itself with the dock first using front-first docking and then dock bin-first to evacuate the bin. In some implementations, the robotic cleaner may wait and charge its battery while docked front-first (e.g., where the batteries are low and the robotic cleaner cannot charge while docked bin-first).

The robotic cleaner backs away from the evacuation station and rotates 180 degrees (step 1008). The robotic cleaner may back a specified distance to ensure that it has sufficient space to rotate. For example, the robotic cleaner may back up far enough so that it clears the lower platform 204 of the example evacuation station of FIG. 9.

The robotic cleaner docks bin-first (step 1010). For example, the robotic cleaner may use the bin navigational sensor 59 of FIG. 3C to properly align with the evacuation station. The robotic cleaner may also use electrical contacts (e.g., the electrical contacts 208*a* and 208*b* of FIG. 9) for alignment while backing into the evacuation station.

The robotic cleaner waits during bin evacuation (step 1012). For example, the evacuation station may detect that the robotic cleaner has docked properly (e.g., using magnets and reed switches as described above with respect to FIGS. 8A-8B) and send a control signal to a portable vacuum to begin providing suction. The evacuation station or the portable vacuum includes a timing mechanism configured to provide suction for a specified amount of time. The amount of time may be based on a size of the robotic cleaner's bin. If the evacuation station evacuates different types of bins, the evacuation station may receive a signal indicating a size or an evacuation time.

The robotic cleaner drives forward away from the evacuation station (step 1014). Depending on the state of charge of the robotic cleaner's batteries, it may continue cleaning as it was before the bin full event, or it may drive forward, rotate 180 degrees and dock front-first to charge its batteries.

Figure 11:
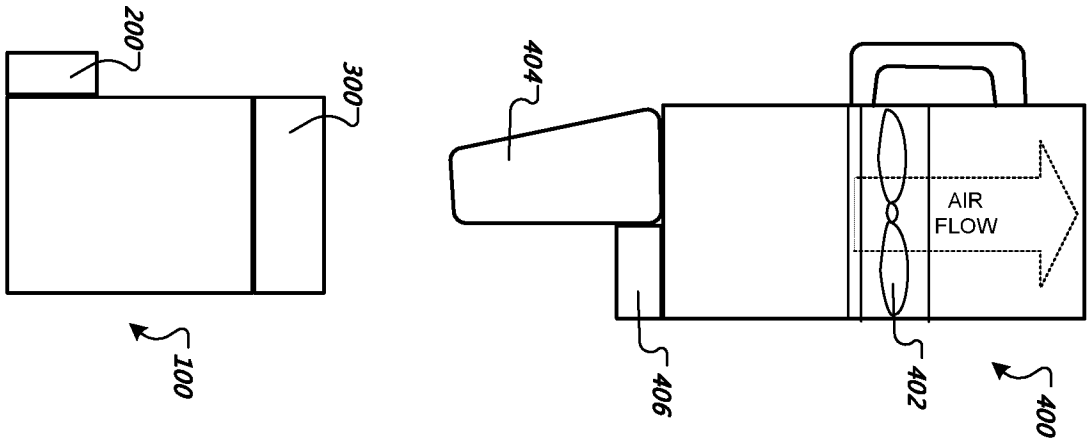
FIG. 11 is a schematic diagram of an evacuation station and an example portable vacuum.

FIG. 11 is a schematic diagram of an evacuation station 100 and an example portable vacuum 400. The portable vacuum 400 includes a vacuum motor 402 configured to suck air into the portable vacuum 400. The portable vacuum 400 is configurable to suck air through either a cleaning head including a standard vacuum attachment 404 (e.g., a conical apparatus including brushes on rollers, or a tube connected to a slotted channel cleaning head, or the like) or through an evacuation port 406 configured to mate with the vacuum interface 300 of the evacuation station 100.

In some implementations, the portable vacuum 400 is generally configured to suck air through the standard vacuum attachment 400. When the portable vacuum 400 mates with the vacuum interface 300 of the evacuation station 100, the portable vacuum 400 becomes configured to suck air through the evacuation port 406. For example, the portable vacuum 400 may include a mechanical bypass, e.g., a valve, that routes suction from the vacuum motor 402 to either the standard vacuum attachment 404 or the evacuation port 406. The force of a person pushing the portable vacuum 400 into the evacuation station 100 may actuate the valve.

In another example, the portable vacuum 400 may include an electrically actuated valve. The electrically actuated valve may draw power through the evacuation station 100. For example, the force of a person pushing the portable vacuum 400 into the evacuation station 100 may mate charging connectors for the portable vacuum 400 to the evacuation station 100, which may be, e.g., plugged into a wall socket. The vacuum interface 300 may include features for increasing the reliability of the mating between the portable vacuum 400 and the evacuation station 100. For example, the vacuum interface 300 may include a mechanical alignment structure (e.g., a tapered structure for guiding), electrical terminals including spring biasing or detents, or the like.

If the portable vacuum 400 is a corded vacuum, the evacuation station may have an AC plug, and the evacuation station 100 may be configured to pass AC current directly to the portable vacuum 400. Alternatively, the portable vacuum 400 can be plugged directly into the wall and powered without drawing power from the evacuation station 100.

In some implementations, the vacuum interface 300 includes a custom port. The portable vacuum 400 may be an AC or DC vacuum with, e.g., a custom power thin cord (e.g., retractable, spoolable, or both) to match the custom port. The evacuation station 100 may include power adapters (e.g., wall warts) for AC plugs for custom power.

The evacuation port 406, separate from the standard vacuum attachment 404, is useful for a number of reasons. Mating a standard vacuum attachment 404 may adversely affect its efficacy in normal use (e.g., by wearing parts down by friction), or be difficult to configure for reliable airtight mating. Moreover, a brush or slotted channel cleaning head may reduce the air velocity and thus the ability of the portable vacuum 400 to thoroughly evacuate debris from a robotic cleaner's bin 50.

In some implementations, the evacuation port 406 is configured for high air velocity. For example, the evacuation port 406 may include a tube having a small diameter, e.g., 1.5 inches or less. The tube is preferentially round, unobstructed, substantially straight, lacks sharp turns, and minimizes any turns. The tube may be wide enough to pass certain kinds of debris; for example, the tube may have a diameter of at least ¾ of an inch to pass two cheerios. An airflow of 0.0188 m^3/s is sufficient for evacuation in some implementations.

Figure 12A:
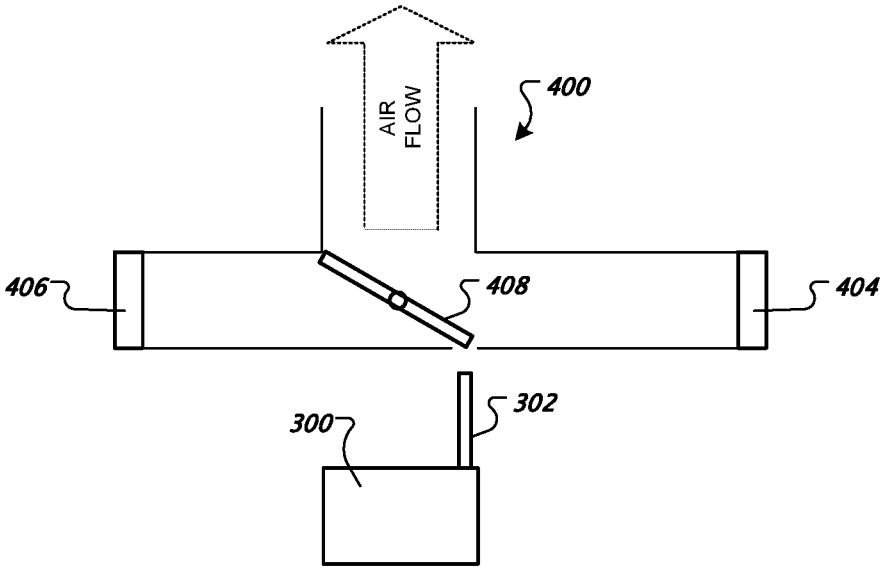
FIGS. 12A-12B are schematic diagrams of an example bypass mechanism for a portable vacuum.
Figure 12B:
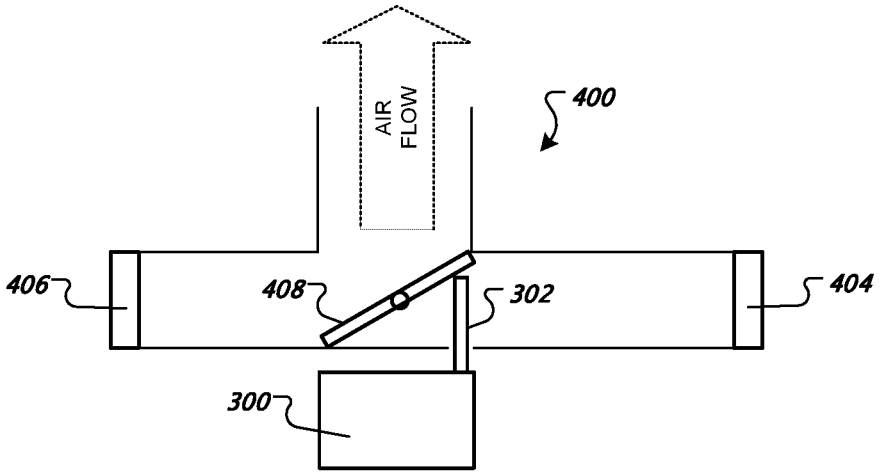

FIGS. 12A-12B are schematic diagrams of an example bypass mechanism 408 for a portable vacuum 400. When the portable vacuum 400 is not mated to a vacuum interface 300 of an evacuation station, the portable vacuum 400 draws air through a standard vacuum attachment 404. When the portable vacuum 400 is mated to the vacuum interface 300, a poker 302 of the vacuum interface 300 engages the bypass mechanism 408 to configure the portable vacuum 400 to draw air through an evacuation port 406.

FIGS. 13A-D show a sequence of events that occur during an example docking operation between an example robotic cleaner 10 and an example evacuation station. During docking, the robotic cleaner moves closer to the evacuation station, creating a seal between a port door 56 of a bin 50 and an evacuation connector 202, so that debris 1302 can be evacuated from the bin 50 into the evacuation station. The debris 1302 can accumulate at the bottom of the bin 50 by gravity.

The evacuation connector 202 leads to an evacuation chamber 210 which is connected to, e.g., a hose 212. A hose 212 upstream of the evacuation connector 202 can be useful, for example, to maintain circular cross section air flow while absorbing lateral movement. Hence the hose 212 can be useful even if evacuation station includes a mechanically docked hand vacuum (e.g., FIG. 11). The evacuation station also includes a poker 206 configured to engage the port door 56 during docking and open the port door 56.

The robotic cleaner 10 includes a sweeping chamber 14 that includes, for example, a vacuum motor and rollers. The bin 50 includes a filter 54 and a bin door 64. The filter 54 allows air to pass during cleaning and collects debris 1302. The bin 50 is shaped by a bin upper wall 66, a bevel 68, and a vertical baffle 70. The baffle 70 is configured to route horizontal airflow from the evacuation connector 202 to vertical airflow, providing a path for the debris 1302 out of the bin 50.

The evacuation connector can include a reed switch 214. The reed switch 214 is configured to be actuated when a magnet 72 in the bin 50 is brought within a certain distance of the reed switch 214. When the robotic cleaner 10 is docked, the reed switch 214 activates a vacuum that provides suction to evacuate the bin 50. Alternatively, a mechanical switch can be used to activate the vacuum that provides suction to evacuate the bin 50.

Figure 13A:
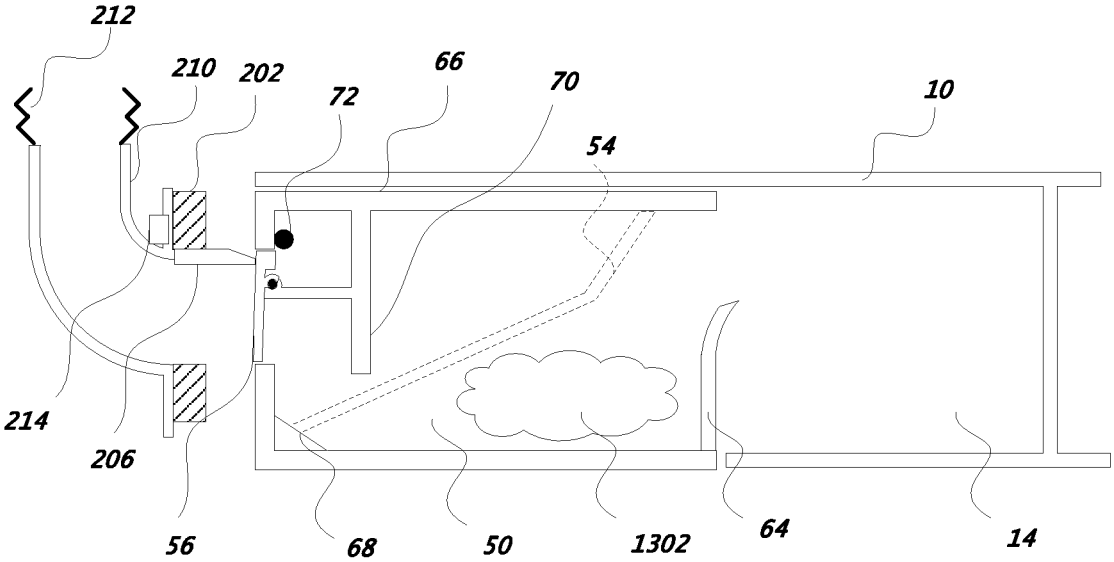
FIGS. 13A-D show a sequence of events that occur during an example docking operation between an example robotic cleaner and an example evacuation station.
Figure 13B:
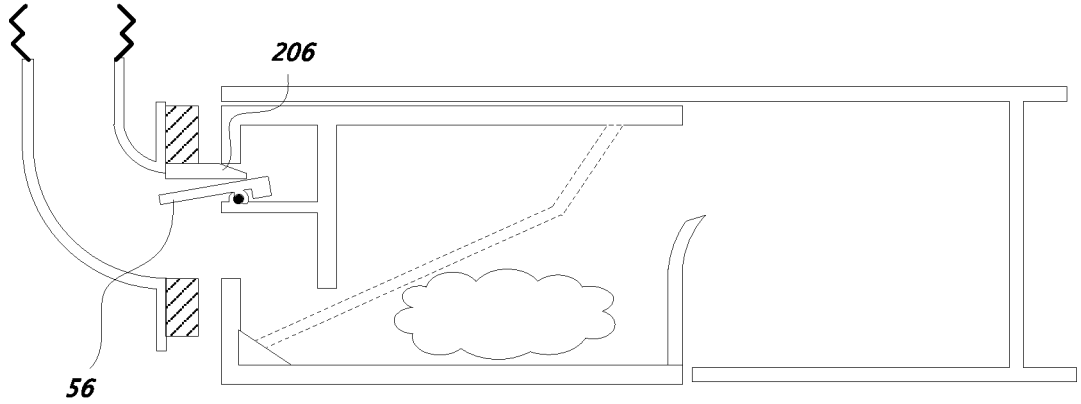

In FIG. 13A, the poker begins to engage the port door 56 as the robotic cleaner approaches. In FIG. 13B, the poker has pushed the port door 56 has been opened by the poker 206. Because the port door 56 opens by the motion of the robotic cleaner docking, additional actuators need not be present to rotate the port door 56. The robotic cleaner is configured to dock with enough force to open the port door 56 even though the port door is normally secured closed (e.g., the robotic cleaner can overcome the force of a spring that secures the port door.)

Figure 13C:
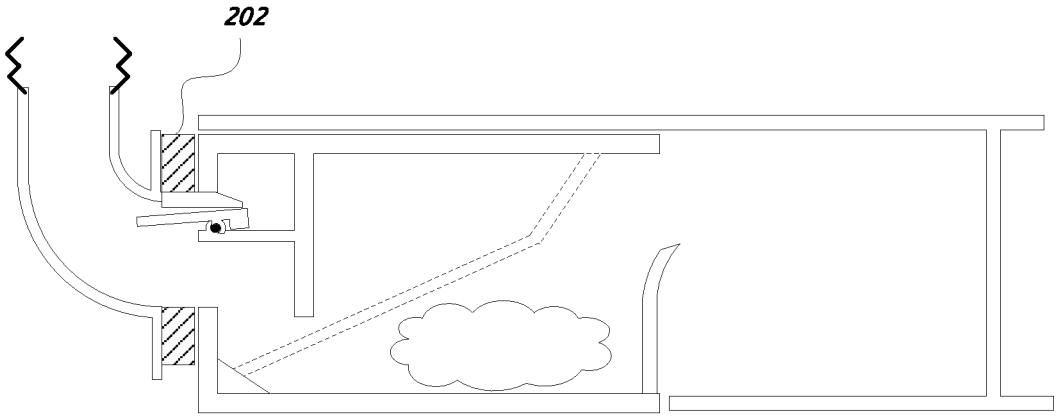
Figure 13D:
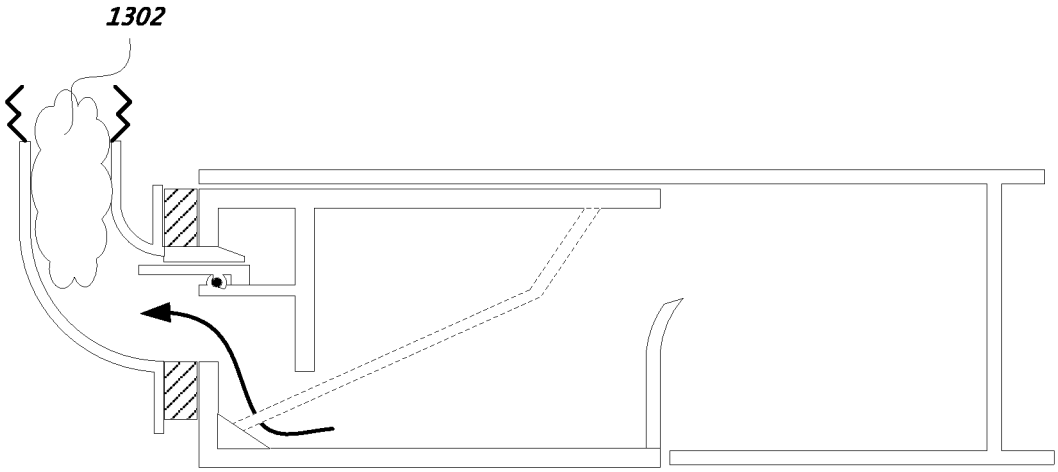

In FIG. 13C, the evacuation connector contacts the bin, forming a seal. The vacuum of the evacuation station is activated (e.g., by the reed switch 214, or a mechanical switch). In FIG. 13D, the debris 1302 is evacuated from the bin 50 into the evacuation station.

Figure 14A:
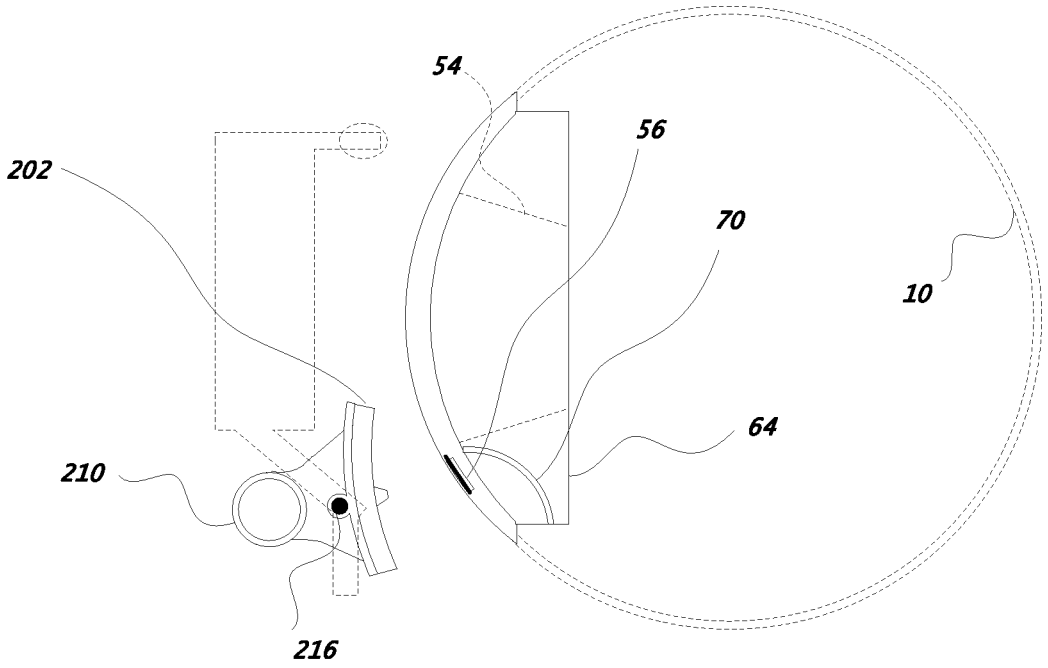
FIGS. 14A-C show overhead views of a sequence of events that occur during an example docking operation between an example robotic cleaner and an example evacuation station.
Figure 14B:
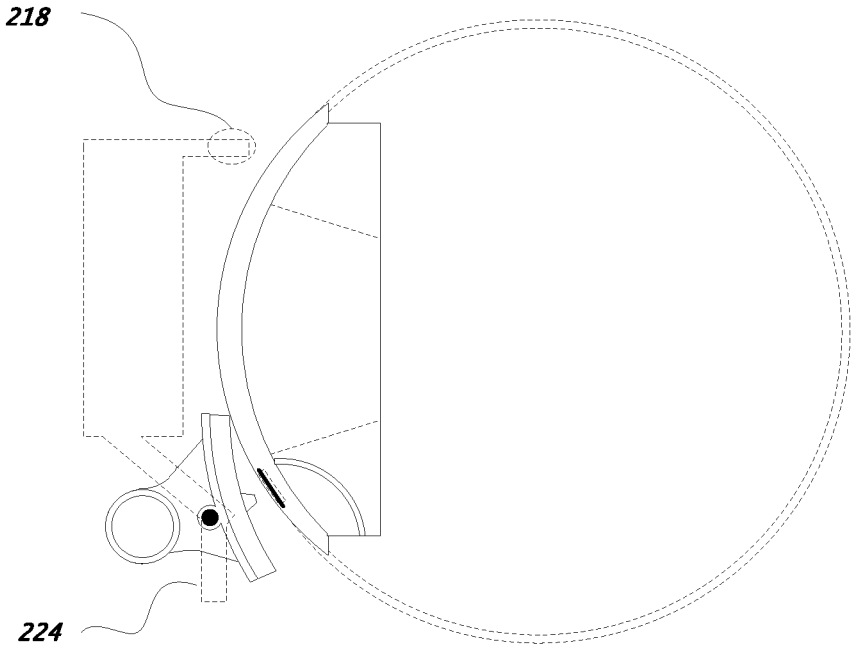
Figure 14C:
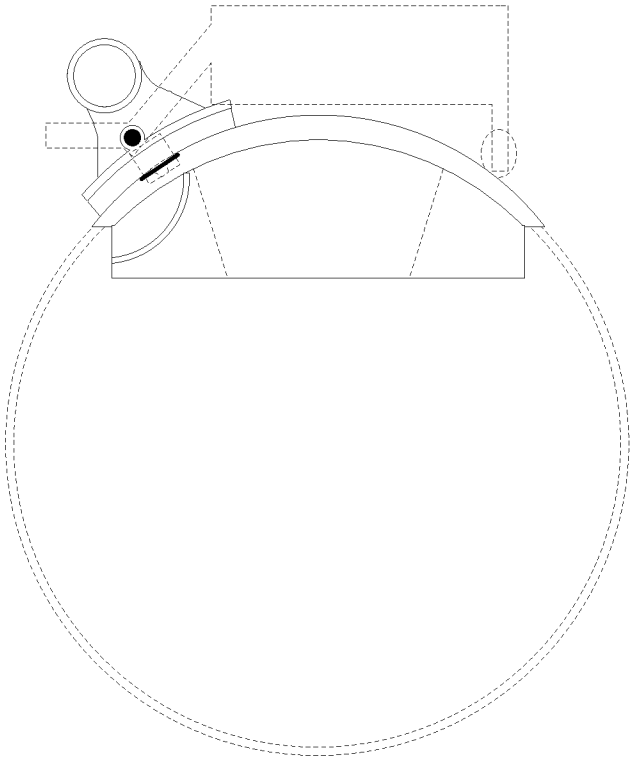

FIGS. 14A-C show overhead views of a sequence of events that occur during an example docking operation between an example robotic cleaner 10 and an example evacuation station. The robotic cleaner 10 includes a bin with a filter 54, a baffle 70 configured to direct horizontal airflow to a vertical direction, a bin door 64, and a port door 56. The baffle 70 can be a curved wall.

The baffle 70 can be configured to extend the airflow directed by the baffle 70 a certain distance laterally, for example, more than 1/10 the width of the bin, or nearly 1/5 the width of the bin or more. The baffle 70 can be curved, for example, so that it does not consume more bin volume (e.g., than a lower diameter tube) and still directs airflow further into the bin than a flat wall would.

The evacuation station includes an evacuation connector 202, an evacuation chamber 210 coupled to the evacuation connector 202 to receive debris, and a pivot 216 that the evacuation connector 202 rotates about. The evacuation chamber 210 can also rotate about the pivot 216.

In FIG. 14A the robotic cleaner 10 begins to approach the evacuation station. The robotic cleaner 10 aligns along a center line of a docking corridor of the evacuation station, and then moves towards the evacuation station. The docking corridor is configured to tolerate some error by the robotic cleaner 10 in its alignment with the center line, e.g., 10 degrees or less of error.

In FIG. 14B, the robotic cleaner 10 makes contact with the evacuation connector, a protruding stopping member 218, or both. The protruding stopping member protrudes from the side of the evacuation station opposite the side with the evacuation connector 202.

By contacting both the evacuation connector 202 and the protruding stopping member 218, the robotic cleaner can create a firm seal (e.g., substantially airtight) between the evacuation connector 202 and the port door 56 as the evacuation connector 202 rotates about the pivot 216. As described above, the evacuation connector 202 can be formed of foam or other material that permits resilient contact and also supports the firm seal.

A stopper 224 on the side of the evacuation connector 202 opposite the robotic cleaner 10 prevents the evacuation connector 202 from rotating too far about the pivot 216. For example, the stopper 224 can be configured so that the evacuation connector 202 can pivot through 40 degrees. Although the evacuation connector 202 is shown as being offset from the center line (to match the port door 56 which is not in the center of the robot 10), the port door 56 and the evacuation connector 202 can be aligned with the center line of the docking corridor. In that case, the evacuation connector 202 can be constrained (e.g., by the stopper 224) to rotate only through 5-20 degrees.

The evacuation connector 202 can have a curvature that is wide enough to assist in forming a seal even though there is uncertainty in the position of the port door 56 (e.g., because of navigational uncertainty). For example, the evacuation connector 202 can be about two times or three times the width of the opening by the port door 56.

In FIG. 14C, the robotic cleaner is pressed against both the protruding stopping member 218 and the evacuation connector 202. A substantially airtight seal is formed between the evacuation connector 202 and the open port door 56. The evacuation connector 202 is substantially aligned with the rear wall of the robotic cleaner 10 when docked.

Figure 15A:
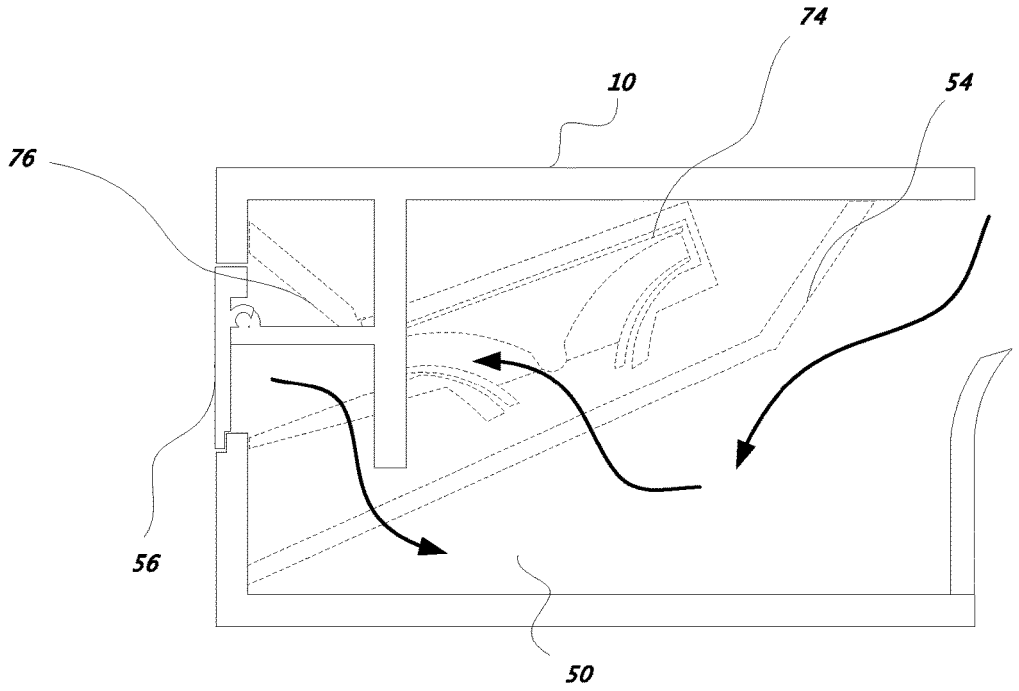
FIG. 15A shows a side view of airflow through an example robotic cleaner during normal vacuum operation, e.g., when the robotic cleaner is vacuuming debris off of a floor.

FIG. 15A shows a side view of airflow through an example robotic cleaner 10 during normal vacuum operation, e.g., when the robotic cleaner 10 is vacuuming debris off of a floor. A fan 74 draws air and debris into the bin 50, and a filter 54 keeps debris from the fan 74. The fan 74 also creates suction at the port door 56 that can assist in keeping the port door closed.

Because the suction created during normal evacuation vacuum operation assists in keeping the port door open, the port door 56 can be configured so that part of the port door 56 swings in to a pocket volume independent from the vacuum chamber when the port door 56 is opened. The pocket volume can be in front of or behind the filter. Exhuast 76 flows out of the robot cleaner 10 as the air and debris is drawn in by the fan 74. The port door 56 can be next to an exhaust vent.

Figure 15B:
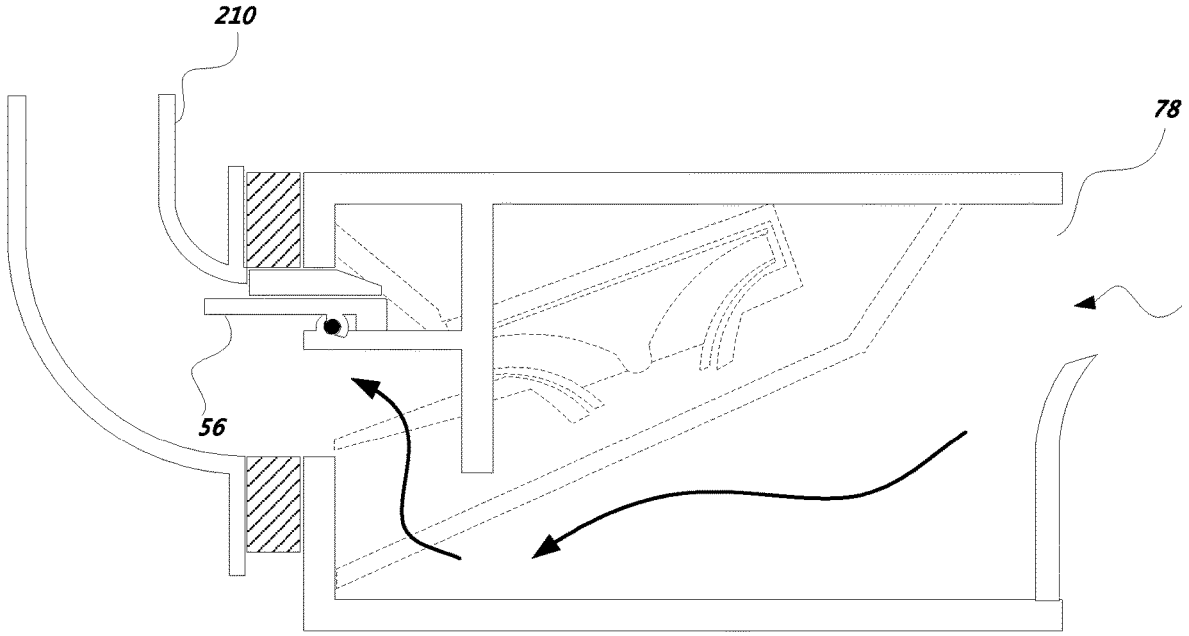
FIG. 15B is a schematic side view of airflow through the example robotic cleaner during evacuation to an evacuation station.

FIG. 15B is a schematic side view of airflow through the example robotic cleaner 10 during evacuation to an evacuation station. The port door 56 is held open (e.g., by a poker.) Suction in the evacuation chamber 210 draws air and debris out of the bin 50. Some air draw is permitted through the bin mouth 78.

Figure 16A:
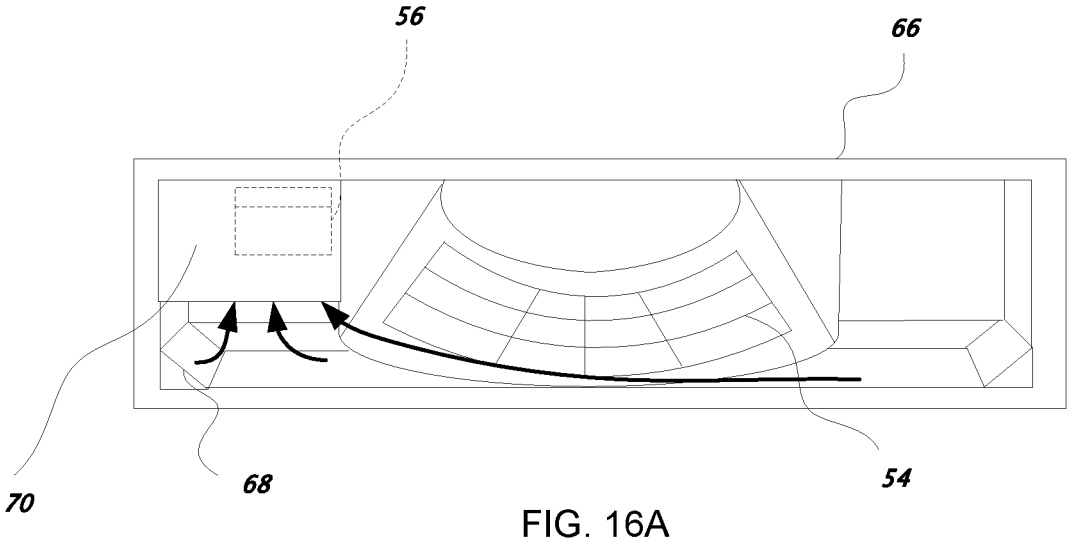
FIG. 16A is a schematic view of the inside of a bin of a robotic cleaner. The view is from the inside of the bin facing out.

FIG. 16A is a schematic view of the inside of a bin of a robotic cleaner. The view is from the inside of the bin facing out. The bin includes a bin upper wall 66 and a filter 54. The bin includes a port door 56 which is behind a vertical baffle 70 (and illustrated by dashed lines to indicate its location behind the baffle 70). Suction from the evacuation station draws air and debris through the port door 56. The bevel 68 and vertical baffle 70 serve to redirect airflow through the bin and out the port door 56. The air and debris flows around the filter 54 and out the port door 56 to the evacuation station.

Figure 16B:
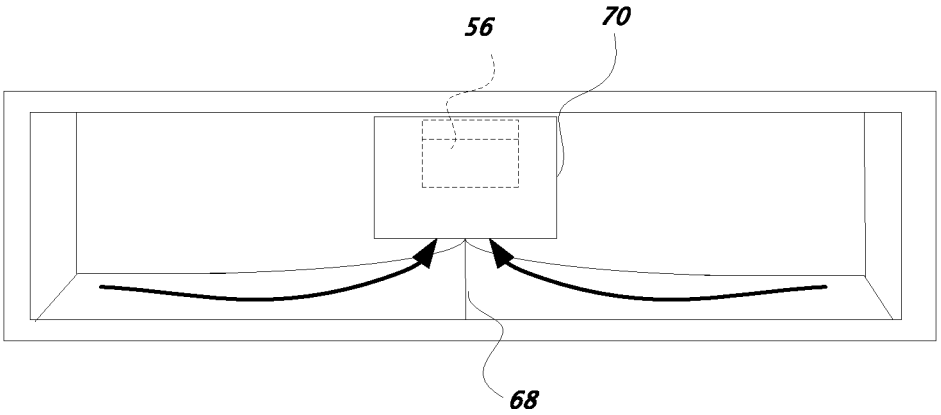
FIG. 16B is a schematic view of a bin that does not show a motor or a filter.

FIG. 16B is a schematic view of a bin that does not show a motor or a filter. The port door 56 is located in the center of the bin. A bevel 68 and a baffle 70 serve to direct air to the rear wall and center.

Figure 16C:
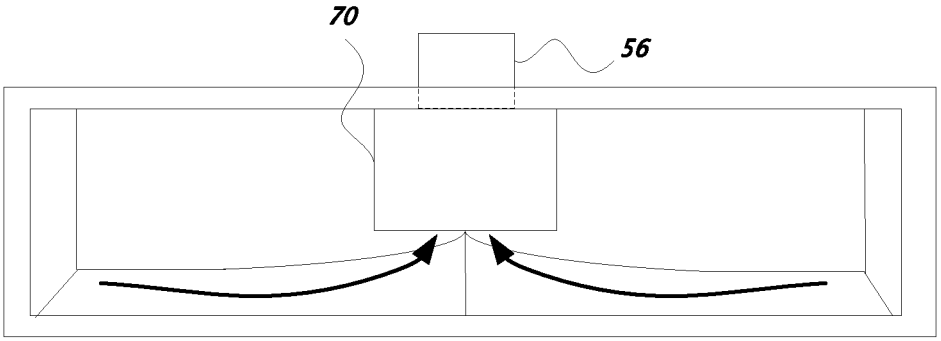
FIG. 16C is a schematic view of the bin with the port door on top of the bin.

FIG. 16C is a schematic view of the bin with the port door 56 on top of the bin. The port door 56 can be configured to open on contact with a poker of an evacuation connector as described above.

Figure 17:
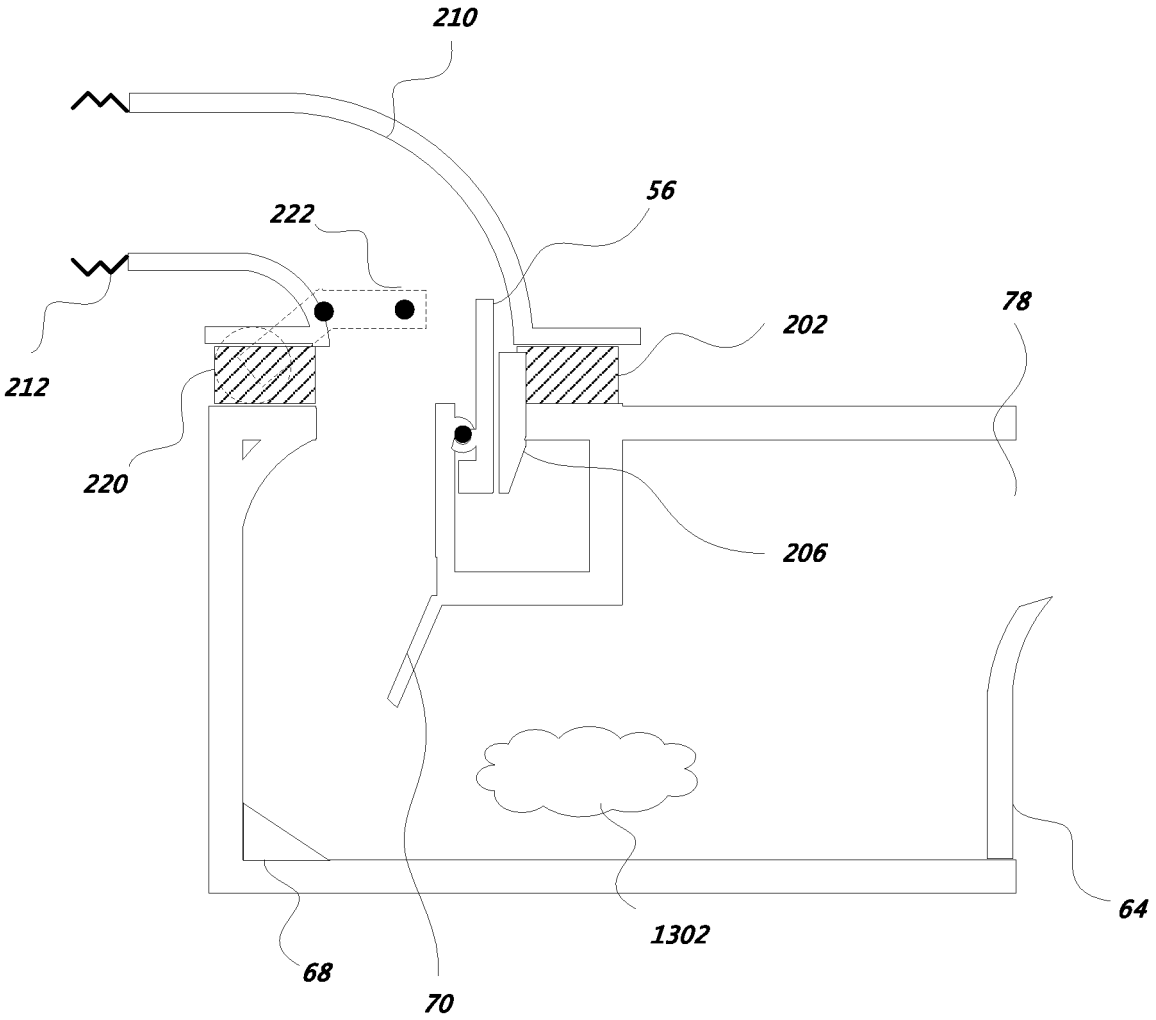
FIG. 17 is a schematic view of a bin having a port door on the top of the bin.

FIG. 17 is a schematic view of a bin having a port door 56 on the top of the bin. When the robotic cleaner docks, the poker 206 on the evacuation connector 202 opens the port door 56 to evacuate debris 1302 into the evacuation chamber 210. Because the port door 56 is on the top of the bin, lateral movement from the robotic cleaner does not secure the seal between the evacuation connector 202 and the bin. A mating device, for example, a small wheel 220 and pivoted arm 222, can apply pressure to the evacuation connector 202 to create a substantially airtight seal. The pivoted arm 222 can be configured to move about the wheel 220, for example, by a servo motor actuated by a reed switch (e.g., a reed switch 214 that also actuates a vacuum to evacuate the bin).

Figure 18:
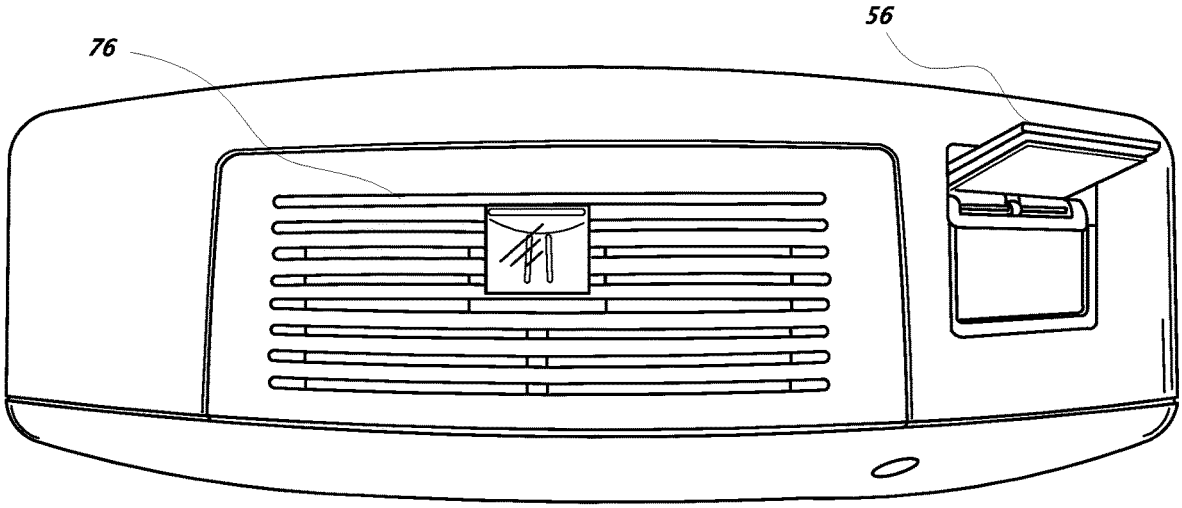
FIG. 18 is a view of a bin for a robotic cleaner from the outside.

FIG. 18 is a view of a bin for a robotic cleaner from the outside. The bin includes a port door 56 that is off center. The port door 56 can be opened, e.g., by a poker, for evacuation of debris within the bin. The bin also includes a vent where exhaust 76 can flow out of the bin while the robotic cleaner vacuums debris from the floor.

Figure 19:
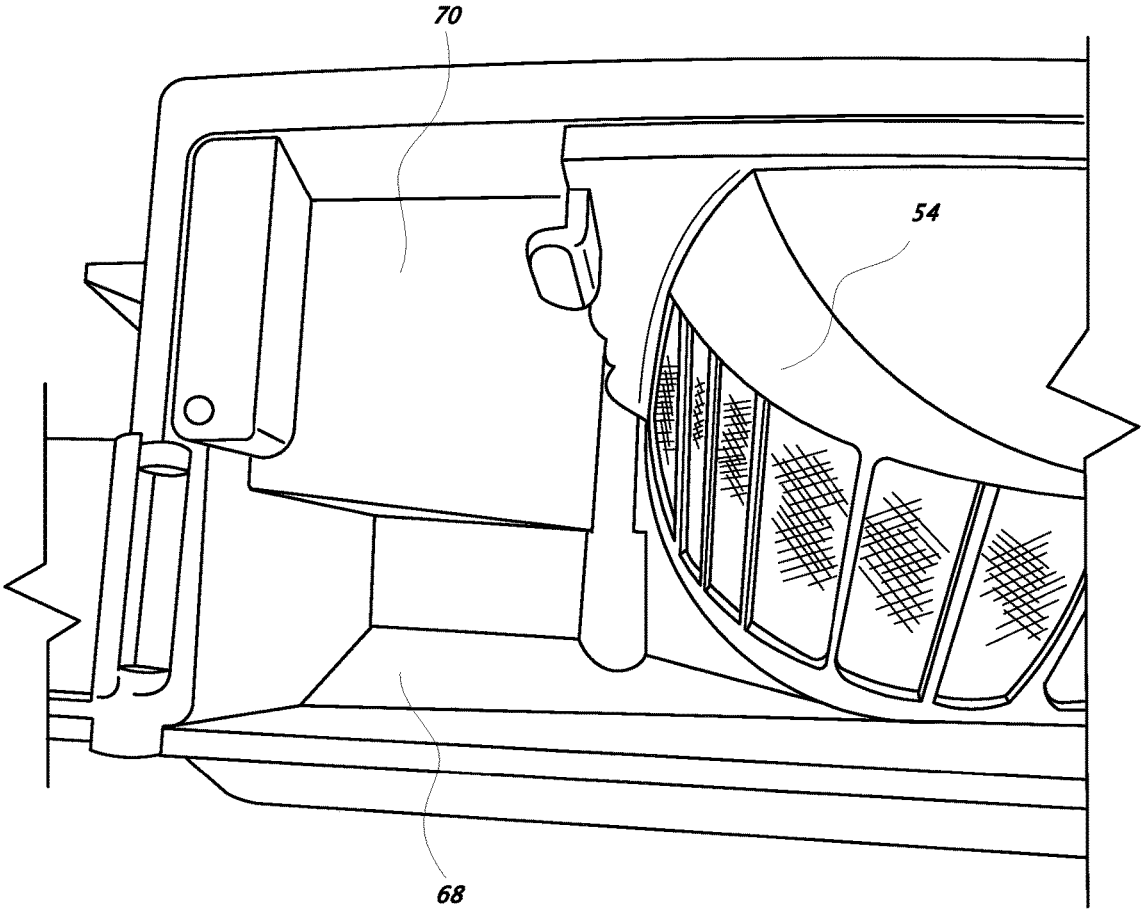
FIG. 19 is a view of a bin for a robotic cleaner from the inside looking out.

FIG. 19 is a view of a bin for a robotic cleaner from the inside looking out. The bin includes a filter 54 that curves around in front of a fan and an exhaust vent. The bin also includes a baffle 70 and a bevel 68 that shape airflow from a port door (behind the baffle) to allow evacuation of debris from the bottom of the bin.

A number of implementations have been described. Nevertheless, it will be understood that various modifications may be made without departing from the spirit and scope of the disclosure. Accordingly, other implementations are within the scope of the following claims.

The invention claimed is:

1. A cleaning system comprising:

an evacuation station comprising a cleaner interface configured to mate with a robotic cleaner, a vacuum interface, and a switch configured to cause production of a signal when the robotic cleaner mates with the cleaner interface; and a handheld portable vacuum configured to mate with the vacuum interface of the evacuation station, the portable vacuum comprising a vacuum motor configured to produce an evacuating airflow through the vacuum interface of the evacuation station to remove debris from a debris bin of the robotic cleaner when the portable vacuum is mated with the vacuum interface of the evacuation station and when the robotic cleaner is mated with the cleaner interface of the evacuation station, and draw air through an opening of the portable vacuum when the portable vacuum is not mated with the vacuum interface of the evacuation station, wherein the opening of the portable vacuum cleaner is configured to mate with a standard vacuum attachment.

2. The cleaning system of claim 1, wherein the cleaner interface comprises an evacuation connector to contact the robotic cleaner when the robotic cleaner is docked to the evacuation station.

3. The cleaning system of claim 2, wherein the evacuation connector is configured to be aligned with an evacuation port assembly of the robotic cleaner when the evacuation connector is mated with the robotic cleaner.

4. The cleaning system of claim 2, wherein the evacuation connector is configured to form a seal between the evacuation station and the robotic cleaner when the robotic cleaner is mated with the evacuation station.

5. The cleaning system of claim 2, wherein the evacuation connector is configured to contact the debris bin of the robotic cleaner to form a seal between the evacuation station and the robotic cleaner when the robotic cleaner is mated with the evacuation station.

6. The cleaning system of claim 1, wherein the evacuation station is configured to open a port door of the robotic cleaner as the robotic cleaner docks to the evacuation station.

7. The cleaning system of claim 1, wherein the portable vacuum is configured to store the debris removed from the debris bin of the robotic cleaner.

8. The cleaning system of claim 1, wherein the portable vacuum is configured to mate with the evacuation station when the portable vacuum is manually pushed onto the evacuation station.

9. The cleaning system of claim 1, wherein the evacuation station comprises a mechanical alignment structure to align the portable vacuum relative to the evacuation station when the portable vacuum is pushed onto the evacuation station.

10. The cleaning system of claim 1, wherein configurations of the portable vacuum to produce the evacuating airflow through the vacuum interface of the evacuation station comprises configurations to maintain a port door of the robotic cleaner in an open position.

11. The cleaning system of claim 1, wherein the portable vacuum comprises a bypass mechanism engageable by the evacuation station when the portable vacuum is mated to the evacuation station, the bypass mechanism configured to route airflow produced by the vacuum motor through the vacuum interface of the evacuation station.

12. The cleaning system of claim 11, wherein the bypass mechanism comprises a valve configured to be actuated when the portable vacuum is mated to the evacuation station.

13. The cleaning system of claim 1, wherein the evacuation station is configured to charge a battery of the robotic cleaner when docked to the evacuation station.

14. The cleaning system of claim 1, wherein the evacuation station is configured to charge a battery of the portable vacuum when the portable vacuum is mated to the evacuation station.

15. The cleaning system of claim 1, wherein the evacuation station is configured to provide a control signal to cause the robotic cleaner to initiate a cleaning operation.

16. The cleaning system of claim 1, wherein the evacuation station is configured to detect when the robotic cleaner properly docks to the evacuation station, and cause the portable vacuum to initiate producing the evacuating airflow to remove the debris from the debris bin of the robotic cleaner.

17. The cleaning system of claim 1, wherein the evacuation station or the portable vacuum comprises a timing mechanism configured to produce the evacuating airflow for an amount of time based on a size of the debris bin of the robotic cleaner.

18. The cleaning system of claim 1, wherein the switch comprises a Hall effect sensor.

19. The cleaning system of claim 1, wherein the switch comprises at least one of a reed switch or a photointerruptor.

20. The cleaning system of claim 1, wherein the evacuation station comprises a poker configured to open a port door of the robotic cleaner as the robotic cleaner mates with the cleaner interface of the evacuation station.

21. The cleaning system of claim 1, wherein the cleaner interface of the evacuation station is configured to mate with a first side of the robotic cleaner, and the evacuation station comprises an electrical contact configured to align with an electrical contact on a second side of the robotic cleaner.

22. A cleaning system comprising:

an evacuation station comprising a cleaner interface configured to mate with a robotic cleaner, wherein the cleaner interface is formed of a compliant material, and a vacuum interface; and a handheld portable vacuum configured to mate with the vacuum interface of the evacuation station, the portable vacuum comprising a vacuum motor configured to produce an evacuating airflow through the vacuum interface of the evacuation station to remove debris from a debris bin of the robotic cleaner when the portable vacuum is mated with the vacuum interface of the evacuation station and when the robotic cleaner is mated with the cleaner interface of the evacuation station, and draw air through an opening of the portable vacuum when the portable vacuum is not mated with the vacuum interface of the evacuation station, wherein the opening of the portable vacuum is configured to mate with a standard vacuum attachment.

23. The cleaning system of claim 22, wherein the cleaner interface comprises an evacuation connector to contact the robotic cleaner when the robotic cleaner is docked to the evacuation station.

24. The cleaning system of claim 22, wherein the evacuation station is configured to open a port door of the robotic cleaner as the robotic cleaner docks to the evacuation station.

25. The cleaning system of claim 22, wherein the evacuation station comprises a switch configured to cause production of a signal when the robotic cleaner mates with the cleaner interface.

26. The cleaning system of claim 22, wherein the cleaner interface comprises a substantially rectangular portion formed of the compliant material.

* * * * *